US012605616B2

(12) United States Patent
Masters et al.

(10) Patent No.: US 12,605,616 B2
(45) Date of Patent: Apr. 21, 2026

(54) ELECTRIC ROLLER SKATE SYSTEMS

(71) Applicant: GOLABS Inc., Carrollton, TX (US)

(72) Inventors: Eric Charles Masters, Mount Horeb, WI (US); Ryan Matthew Follmann, Fitchburg, WI (US)

(73) Assignee: GOLABS Inc., Carrollton, TX (US)

( * ) Notice: Subject to any disclaimer, the term of this patent is extended or adjusted under 35 U.S.C. 154(b) by 351 days.

(21) Appl. No.: 18/515,149

(22) Filed: Nov. 20, 2023

(65) Prior Publication Data

US 2024/0390771 A1 Nov. 28, 2024

Related U.S. Application Data

(60) Provisional application No. 63/469,037, filed on May 25, 2023.

(51) Int. Cl.

| | |
|---|---|
| ***A63C 17/12*** | (2006.01) |
| ***A63C 17/04*** | (2006.01) |
| ***A63C 17/14*** | (2006.01) |
| ***A63C 17/22*** | (2006.01) |
| ***A63C 17/26*** | (2006.01) |

(52) U.S. Cl.

CPC ..... *A63C 17/12* (2013.01); *A63C 17/04* (2013.01); *A63C 17/14* (2013.01); *A63C 17/22* (2013.01); *A63C 17/262* (2013.01); *A63C 2203/12* (2013.01); *A63C 2203/42* (2013.01)

(58) Field of Classification Search

CPC ..... A63C 17/12; A63C 17/04; A63C 17/14; A63C 17/22; A63C 17/262; A63C 2203/12; A63C 2203/42; A63C 17/08; A63C 2203/18; A63C 2203/24; A63C 2203/22

See application file for complete search history.

(56) References Cited

U.S. PATENT DOCUMENTS

| | | | |
|---|---|---|---|
| 7,204,330 | B1 | 4/2007 | Lauren |
| 9,526,977 | B2 | 12/2016 | Edney |
| 9,808,705 | B2 | 11/2017 | Treadway et al. |
| 9,814,962 | B2 | 11/2017 | Zhang |
| 10,926,160 | B2 | 2/2021 | Micacchi |
| 11,583,755 | B1 | 2/2023 | Zhu |
| 11,697,469 | B2 | 7/2023 | Desberg et al. |
| 11,707,666 | B2 | 7/2023 | Zhang et al. |
| 2018/0015355 | A1 | 1/2018 | Desberg et al. |
| 2020/0197786 | A1 | 6/2020 | Artemev |

FOREIGN PATENT DOCUMENTS

CN 206404277 U * 8/2017

OTHER PUBLICATIONS

Machine translation of CN-206404277-U (Year: 2017).*

* cited by examiner

*Primary Examiner* — Amr A Awad
(74) *Attorney, Agent, or Firm* — AP3 Law Firm PLLC

(57) ABSTRACT

An electric roller skate system includes a pair of roller skates, where each of the pair of roller skates includes: a base configured to receive a foot of a rider, where the base comprises a front base and a rear base, where a distance between the front base and the rear base is adjustable; a front main body attached to the front base; a rear main body attached to the rear base; an ankle strap attached to the rear main body; two front wheels attached to a bottom of the front base; a rear wheel attached to a bottom of the rear base, where a cross-section of the rear wheel has a barrel shape; a battery; and an electric motor mechanically coupled to the rear wheel.

20 Claims, 24 Drawing Sheets

ELECTRIC ROLLER SKATE SYSTEMS

RELATED APPLICATION

This application claims the priority of U.S. Provisional Application No. 63/469,037, filed on May 25, 2023 and entitled "Electric Roller Skates," which application is hereby incorporated by reference in its entirety.

BACKGROUND

Electric roller skates are becoming a popular way of transportation. However, existing electric roller skates may have limited functionality or poor performance. There is a need for electric roller skates that have high performance, improved functionality, intuitive control, and built-in safety features.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EXAMPLES

Figure 1:
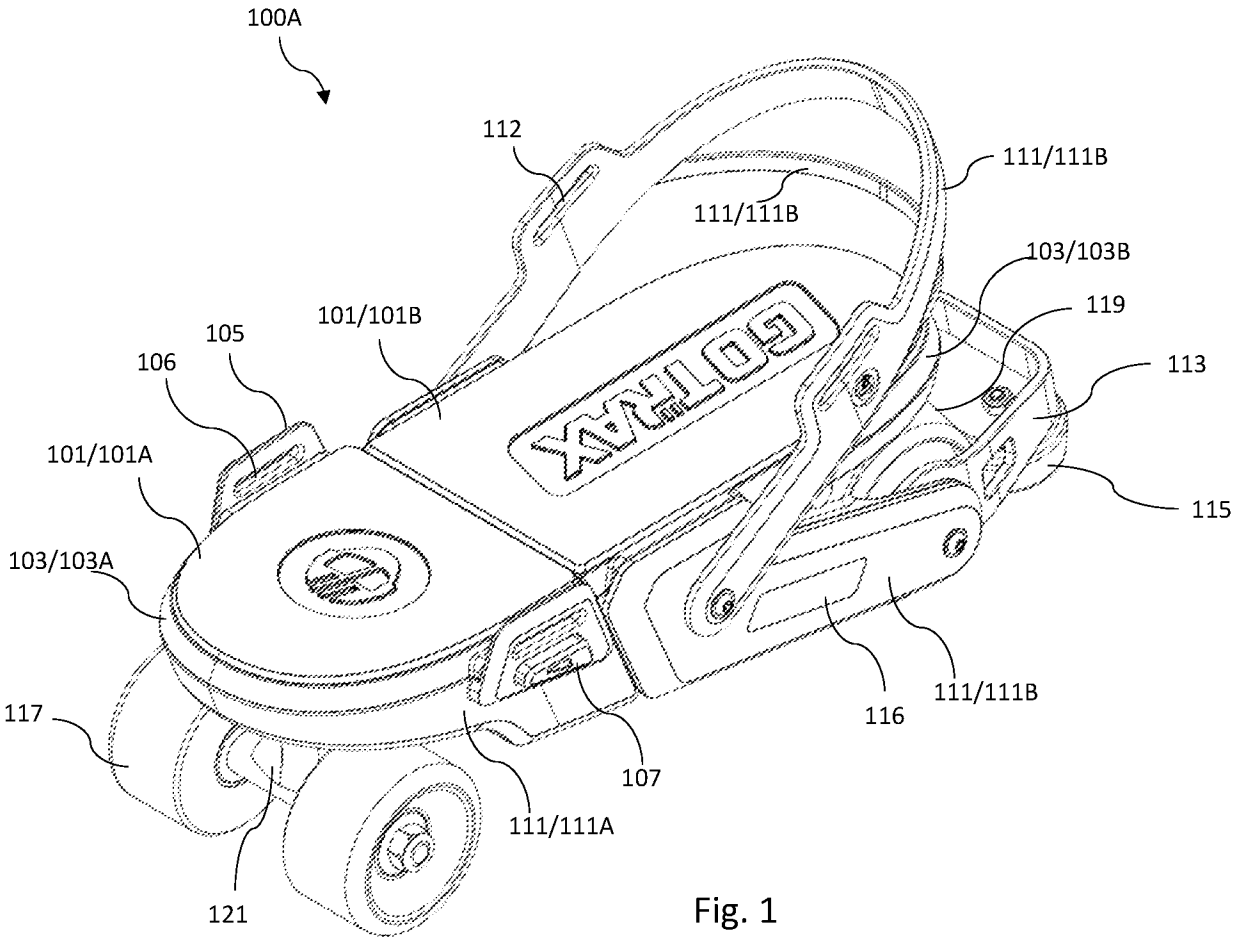
FIGS. 1-6, 7A, 7B, 8A, 8B, 9, and 10 illustrate different views of an electric roller skate, in an embodiment.

The making and using of the presently disclosed examples are discussed in detail below. It should be appreciated, however, that the present invention provides many applicable inventive concepts that can be embodied in a wide variety of specific contexts. The specific examples discussed are merely illustrative of specific ways to make and use the invention, and do not limit the scope of the invention. Throughout the discussion herein, unless otherwise specified, the same or similar reference numerals or labels in different figures refer to the same or similar component.

Figure 5:
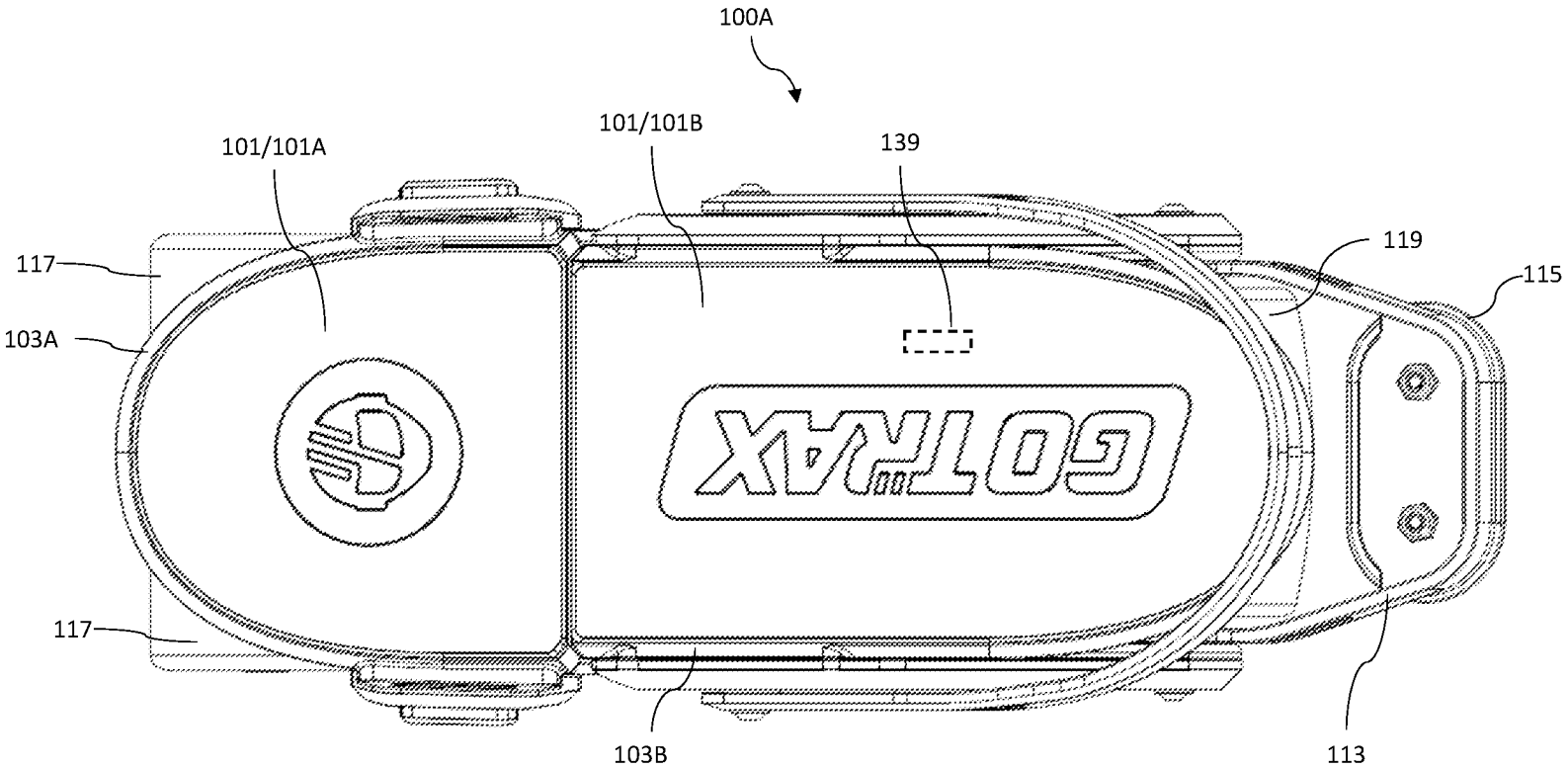
Figure 6:
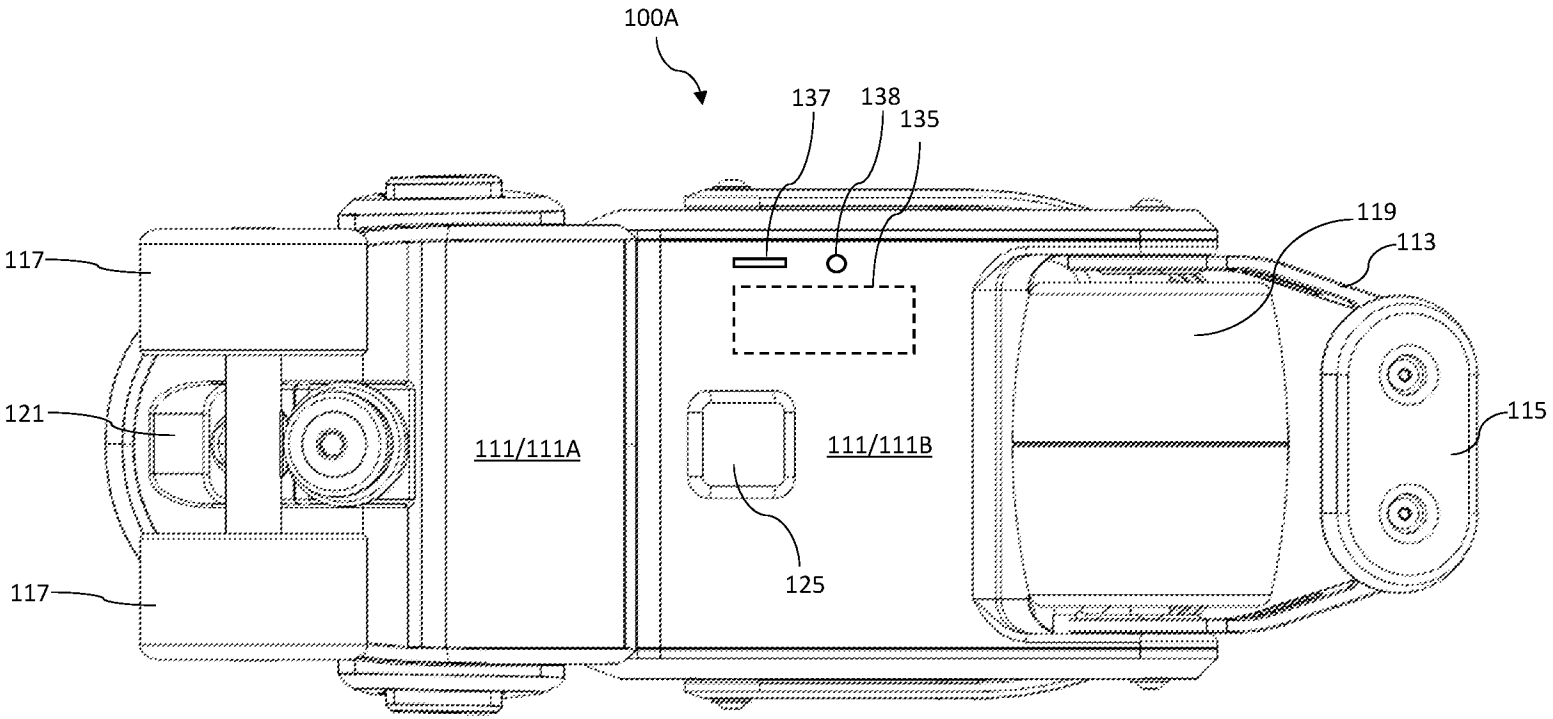
Figure 7B:
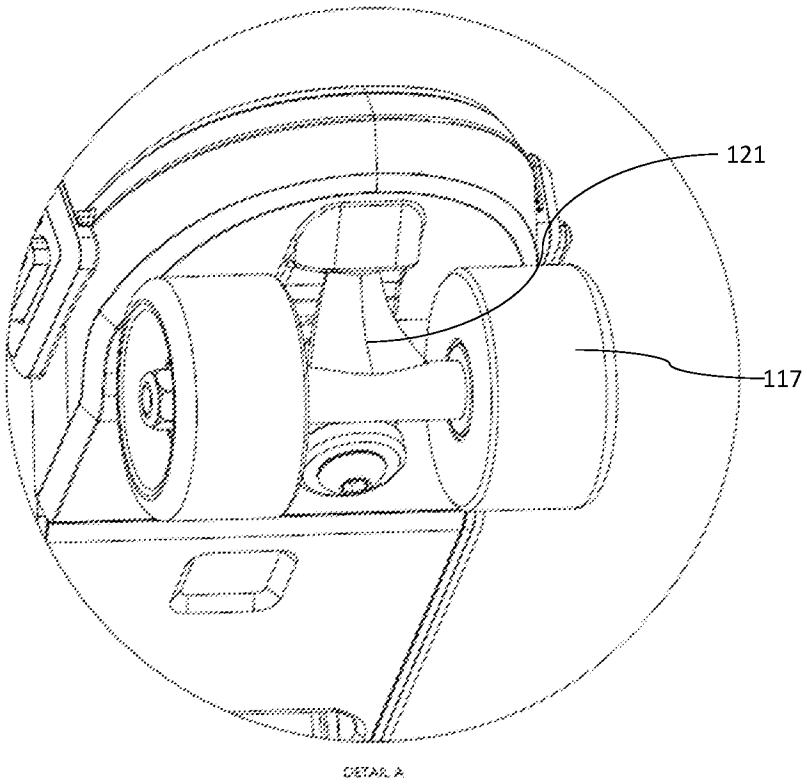
Figure 7A:
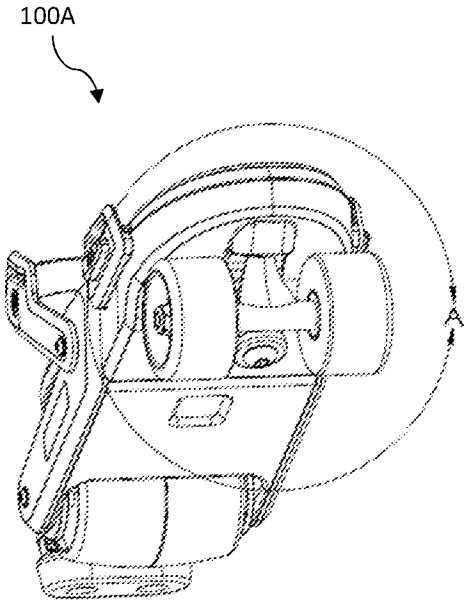
Figure 8B:
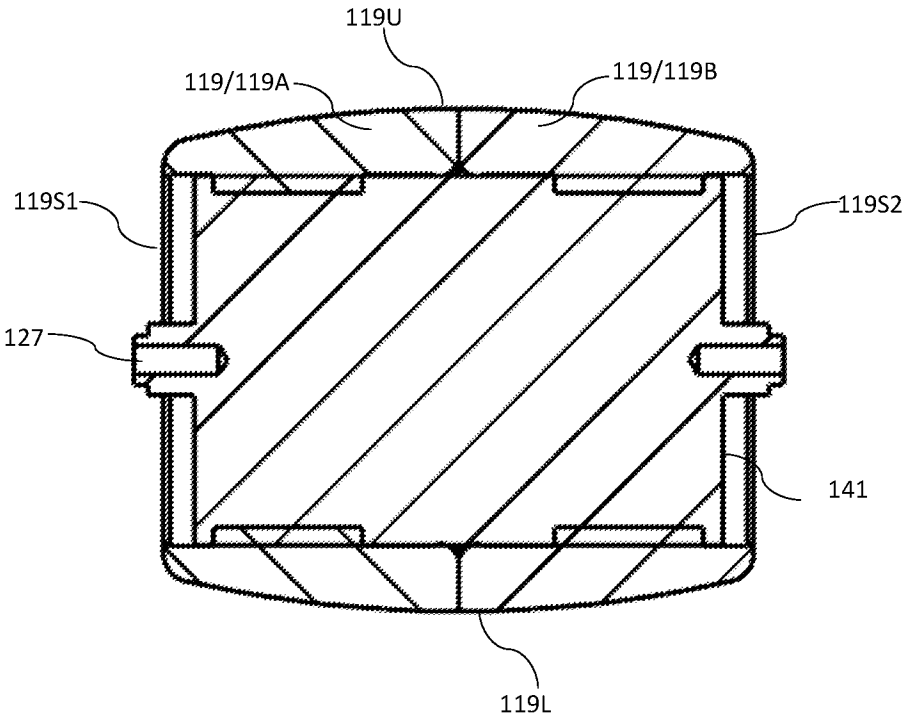
Figure 8A:
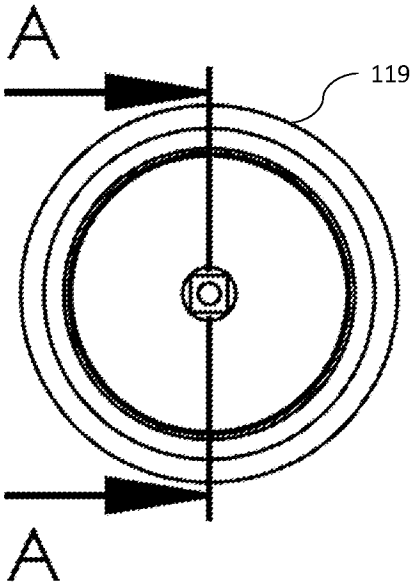

FIGS. 1-6, 7A, 7B, 8A, 8B, 9, and 10 illustrate different views (e.g., perspective view, top view, bottom view, front view, back view, or side view) of an electric roller skate 100A, in an embodiment. In particular, FIGS. 1, 9, and 10 each illustrates a perspective view of the electric roller skate 100A. FIGS. 2, 3, 4, 5, and 6 illustrate a side view, a front view, a back view, a top view, and a bottom view of the electric roller skate 100A, respectively. FIG. 7A illustrates a perspective view of the bottom of the electric roller skate 100A, and FIG. 7B illustrates details of the front wheels and the steering truck of the electric roller skate 100A. FIG. 8A illustrates a sideview of a rear wheel of the electric roller skate 100A, and FIG. 8B illustrates a cross-sectional view of the rear wheel along cross-section A-A in FIG. 8A. For ease of discussion, the electric roller skate 100A (or 100B in FIG. 12-17) may also be referred to as a roller skate. Note that to avoid cluttering, straps 131 (see, e.g., toe strap 131A and ankle strap 131B in FIG. 10) of the roller skate 100A are not shown in FIGS. 1-6, 7A, 7B, and 9, but shown in FIG. 10.

It is understood that the electric roller skate system discussed herein includes two roller skates (e.g., two roller skates 100A, or two roller skates 100B) and a remote control (see FIGS. 10, 11A-11C and discussion thereof), and when a rider (may also be referred to as a user) uses the electric roller skate system, the rider wears shoes and attaches one roller skate (100A, or 100B) to each of his shoes. Discussion hereinafter focuses on one of the roller skates of the electric roller skate system, with the understanding that the other roller skate of the roller skate system has the same or similar structure.

The electric roller skate system operates in two different modes: a normal operation mode and a calibration mode. In the normal operation mode, the rider attaches a roller skate (e.g., 100A or 100B) to each of his shoes, and rides the roller skates as a transportation tool to go to places. The rider holds the remote control in his hand, and uses the remote control to adjust the speed of the roller skates. In the calibration mode, some sensors (e.g., speed sensors) or functionality of the roller skates (e.g., 100A or 100B) are calibrated to compensate for, e.g., temperature shift, component aging, or other effects that degrade the performance of the electric roller skate system. Details are discussed hereinafter.

As illustrated in FIGS. 1-6, the roller skate 100A has a base 103 for receiving the foot of the rider. The base 103 is made of a light-weight and sturdy material to provide structural support, such as a metal material. For example, aluminum, an alloy, or the like may be used to form the base 103. The base 103 includes a front portion, referred to as a front base 103A, where the toe portion of the rider's foot rests on, and includes a rear portion, referred to as a rear base 103B, where the heel portion of the rider's foot rests on.

The distance between the front base 103A and the rear base 103B is adjustable, e.g., by pressing adjustment buttons 107 on both sides of the roller skate 100A while adjusting the distance between the front base 103A and the rear base 103B, such as pulling the front base 103A and the rear base 103B away from each other, or pushing the front base 103A and the rear base 103B toward each other. In some embodiments, the front base 103A and the rear base 103B are attached to a center piece (e.g., an aluminum center piece). The center piece has a plurality of slots, holes, or other position indicators. The front base 103A and/or the rear base 103B can slide along the center piece when the adjustment buttons 107 are pressed, and can lock into a position indicated by one of those position indicators when the adjustment buttons 107 are released (e.g., not pressed). This allows the size of the base 103 to be adjusted to accommodate different shoes sizes.

In the illustrated example, the roller skate 100A has a platform 101 formed on the base 103. The platform 101 may be formed of a soft material (e.g., rubber) to provide comfort and better friction between the rider's shoe and the base 103. The platform 101 includes a front platform 101A formed on the front base 103A, and includes a rear platform 101B formed on the rear base 103B. In the illustrated embodiment, the front platform 101A and the rear platform 101B are attached to (e.g., glued on) the front base 103A and the rear base 103B, respectively.

Figure 2:
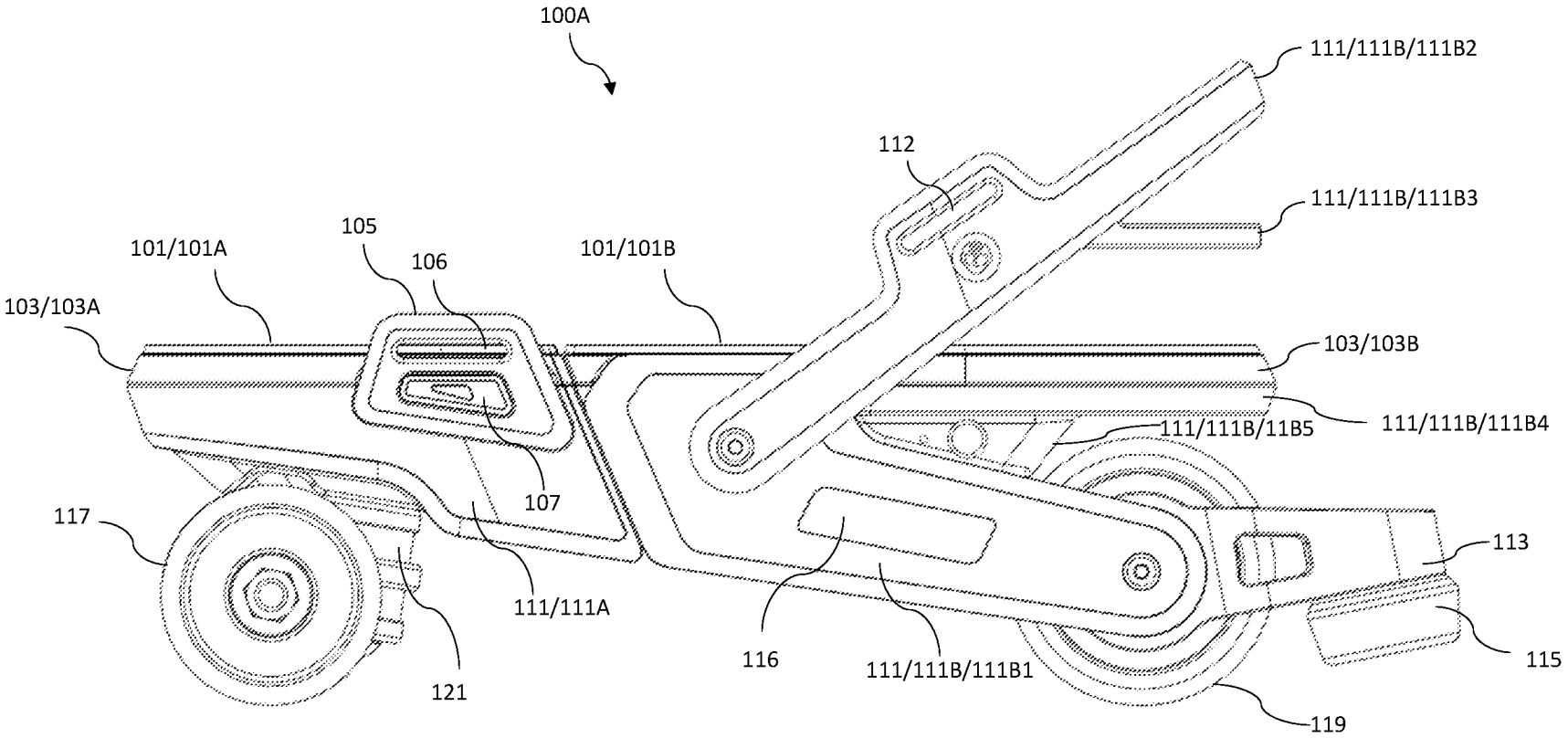
Figure 3:
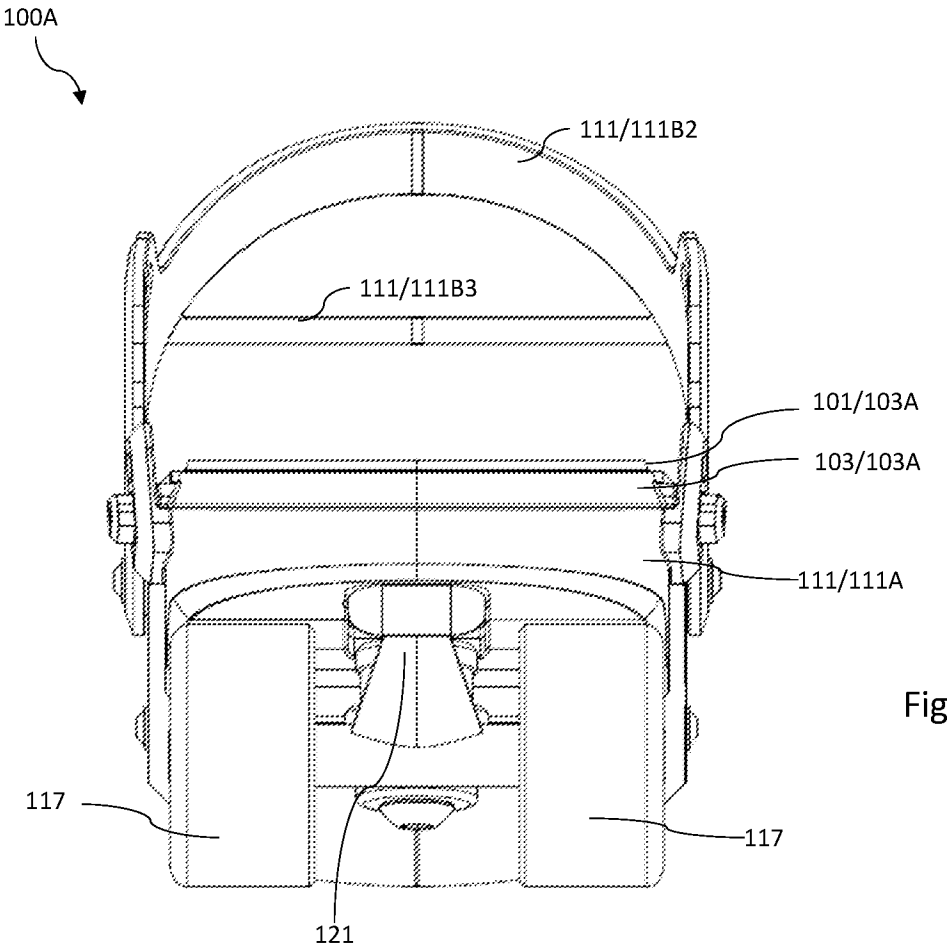

The base 103 is supported by a main body 111 of the roller skate 100A. The main body 111 includes a front main body 111A attached to the front base 103A, and includes a rear main body 111B attached to the rear base 103B. The main body 111 may be formed of a suitable material, such as plastics. In the example of FIG. 1, the front main body 111A is disposed below the front base 103A and comprises a piece of plastics that is substantially the same size (e.g., surface area) as the front base 103A. The rear main body 111B comprises a plurality of portions (labeled as 111B1, 111B2, 111B3, 111B4, and 111B5 in FIG. 2) of different sizes at different locations. For example, as illustrated in FIG. 2, a portion 111B4 is disposed under the rear base 103B and have a substantially same size (e.g., surface area) as the rear base 103B. A portion 111B5 is disposed below the portion 111B4, and may form an enclosure for storing the battery and electrical circuits/components (e.g., processor, control board, power management system, or the like) of the roller skate. A portion 111B1 of the rear main body 111B extends downward and forms an angle with the base 103, and a rear wheel 119 of the roller skate 100A is attached to the portion 111B1. A portion 111B2 extends upward and forms an angle with the base 103. Holes 112 are formed in the portion 111B2 for attaching the ankle strap 131B (see FIG. 10). In addition, a portion 111B3 of the main body is attached to the portion 111B2 and extends parallel to the base 103. The portions 111B2, 111B3, together with the toe strap 131A and the ankle strap 131B (see FIG. 10), fasten the rider's foot securely with the roller skate 100A.

As illustrated in FIGS. 1 and 2, a toe strap bracket 105 is attached to each side of the roller skate 100A. The toe strap bracket 105 may be formed of plastics, and may be attached to the front base 103A or the front main body 111A. A hole 106 is formed in the toe strap bracket 105 for attaching the toe strap 131A (see FIG. 10). In the illustrated example, an adjustment button 107 is formed on the toe strap bracket 105. As discussed above, the distance between the front base 103A and the rear base 103B can be adjusted by pressing the adjustment buttons 107.

In the illustrated embodiment, front wheels 117 (e.g., two front wheels 117) are attached to the bottom of the front base 103A (e.g. through the front main body 111A) using a steering truck 121. The steering truck 121, which may also be referred to a skateboard truck, is known and used in skateboard designs. The steering truck 121 allows the front wheels 117 to turn at an angle with a longitudinal direction of the base 103, which longitudinal direction is along a direction from a rear end of the base 103 (where the heel of the rider rests on) toward the front end of the base 103 (where the toes of the rider rest on). The steering truck 121 allows for side-to-side flexing of the roller skate 100A, easier turning, and the ability of the roller skate to perform the carving maneuver, thereby improving the performance and user experience of the roller skate 100A. The front wheels 117 may be formed of, e.g., rubber. In the illustrated example, the front wheels 117 are not powered (e.g., not powered by an electric motor), and thus are freewheeling during operation.

The rear wheel 119 is attached to the portion 111B1 (see FIG. 2) of the rear main body 111B. The rear wheel 119 may be formed of a same material (e.g., rubber) as the front wheels 117. In the illustrated embodiments, there is only one rear wheel 119 in the roller skate 100A. The rear wheel 119 is powered (e.g., driven) by an electric motor during the normal operation mode. The electric motor may be a brushless hub motor, or the like. The electric motor is mechanically coupled to the rear wheel 119, and may be integrated into the rear wheel 119. In some embodiments, a speed sensor is coupled to the electric motor and/or the rear wheel 119, and is used to measure the rotational speed of the rear wheel 119. The rotational speed (e.g., round-per-minute (rpm) measurement) of the rear wheel 119 may be easily translated into the speed (e.g., linear speed) of the roller skate 100A, given the size of the rear wheel 119, as skilled artisans readily appreciate. The speed sensor may be coupled to or integrated into the electric motor or the rear wheel 119. More details of the rear wheel 119 are discussed below with reference to FIGS. 8A and 8B. In other embodiments, the speed sensor may be coupled to the front wheel 117.

Referring to FIGS. 8A and 8B, which illustrate a side view and a cross-section view of the rear wheel 119, respectively. The cross-sectional view in FIG. 8B is along the cross-section A-A in FIG. 8A. As illustrated in FIG. 8B, the real wheel 119 has a barrel-shaped cross-section. For example, the rear wheel 119 has two straight sidewalls (e.g., sidewalls 119S1 and 119S2) on opposing sides, a curved upper surface 119U (e.g., a convex upper surface), and a curved lower surface 119L (e.g., a convex lower surface). The curved upper surface 119U (or the curved lower surface 119L) extends continuously from a first sidewall (e.g., 119S1) to a second opposing sidewall (e.g., 119S2). The amplitude (e.g., absolute value) of the gradient of the curved upper surface 119U (or the curved lower surface 119L) increases gradually (e.g., without a sudden change such as a step change) from zero in the middle point of the curved upper surface 119U (or the curved lower surface 119L) to a maximum value at the edge of the curved upper surface 119U (or the curved lower surface 119L). As illustrated in FIG. 8B, the rear wheel 119 is the thickest (e.g., measured along the vertical direction of FIG. 8B) at the middle, and narrowest at the edges, thereby forming the barrel-shaped cross-section. The barrel-shaped cross-section allows for easy turning of the roller skate 100A and improves the ability of the roller skate 100A to perform the carving maneuver.

In the example of FIG. 8B, the rear wheel 119 are formed by two symmetric portions 119A and 119B that are joined at the middle. FIG. 8B further illustrates an electric motor 141 integrated into the rear wheel 119, and illustrates the center axis 127 of the electric motor 141. Electric motors are known and used in the art, thus details are not illustrated and discussed. In the illustrated embodiment, the rear wheel 119 is attached to the rear main body 111B by the center axis 127. Unlike the front wheels 117, no steering truck is used to attach the rear wheel 119.

Referring back to FIG. 2, a brake bracket 113 is attached to the rear main body 111B (e.g., the portion 111B1), and a brake 115 is attached to the brake bracket 113. The brake bracket 113 is formed of a metal material, such as aluminum, and the brake 115 is formed of a rubber material, in some embodiments. The brake 115 functions as a physical brake to slow down the roller skate 100A when placed in contact with the ground by the rider, and may also prevent the rider from accidently falling backwards.

Light-emitting diode (LED) may be used to improve the aesthetics of the roller skate. For example, in FIG. 1, LEDs 116 may be used to highlight a logo plate. As another example, LEDs (see 116 in FIG. 12) may be formed around the wheels (e.g., 117, 119). The LEDs 116 may be controlled (e.g., by the processor of the roller skate) to change color and/or light intensity to display a light show, or may display a fixed (e.g., pre-determined) light pattern. Note that FIG. 2 shows one side of the roller skate 100A. The other side of the roller skate 100A is the same as or similar to the side shown in FIG. 2.

Figure 4:
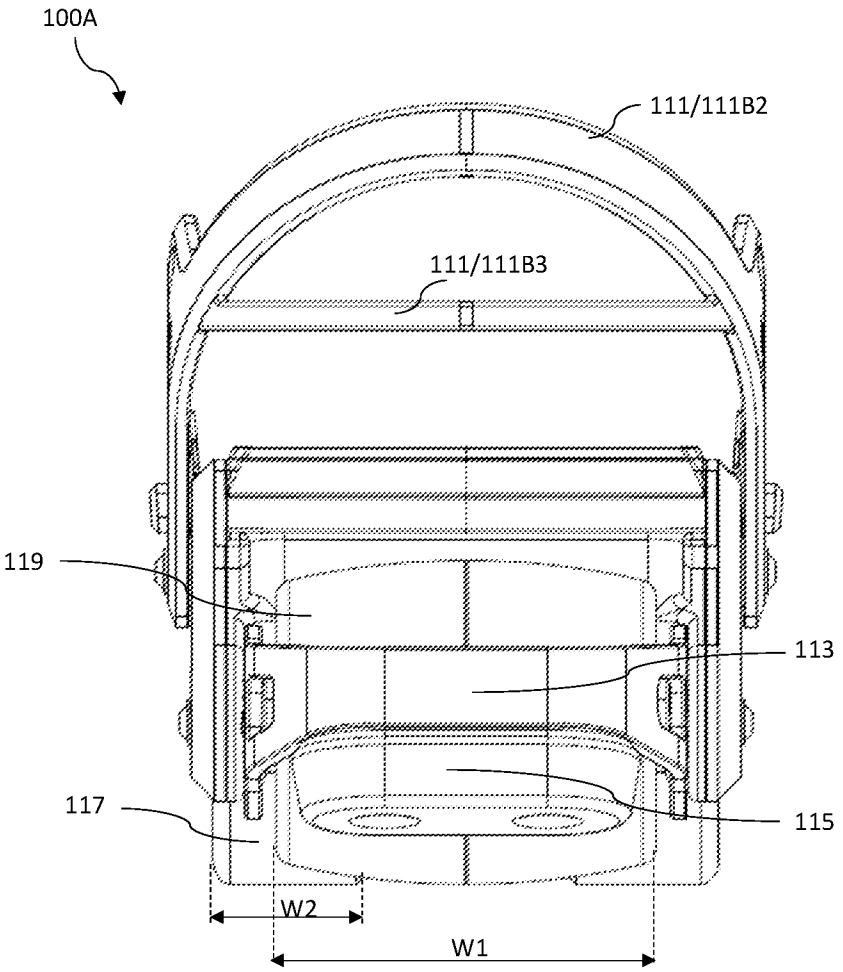

FIG. 4 illustrates the back view of the roller skate 100A. As shown in FIG. 4, the rear wheel 119 has a width $W_1$ that is larger than a width $W_2$ of the front wheel 117. In some embodiments, the width $W_1$ is larger than twice of the width $W_2$, such as larger than $2W_2$ and smaller than $3W_2$ (e.g., $2W_2<W_1<3W_2$). The above choice for the width $W_1$ provides stability and good traction for the roller skate 100A while still allowing for good carving ability and easy turning for the roller skate. A width $W_1$ smaller than the example range may not provide enough stability, traction, and/or driving capability. A width $W_1$ larger than the example range may adversely affect the turning and carving capability.

FIG. 5 illustrates a top view of the roller skate 100A. A sensor 139 is shown in FIG. 5 in dashed lines, because the sensor 139 may be under the platform 101 (e.g., embedded in the base 103) and not visible in the top view. The sensor 139 may be, e.g., a pressure sensor, a tilt sensor, combinations thereof, or the like. The number of sensors and the location of sensors shown in FIG. 5 is a non-limiting example, other numbers and other locations are also possible.

The pressure sensor may be used to sense whether a rider is standing on the roller skate 100A. In some embodiments, more than one pressure sensors are used (e.g., one embedded in the front base 103A, and one embedded in the rear base 103B), which allows detection of the posture of the rider, such as whether the rider is leaning forward or backward. The processor of the roller skate 100A may use such information to better control the roller skate 100A for better performance.

The tilt sensor may be used to measure the position (e.g., an angle between the base 103 and a flat plane representing a flat ground surface) of the roller skate 100A, which may be used to detect whether the roller skate 100A is going downhill, uphill, or traveling on a flat surface. The processor (see 201 in FIG. 19) of the roller skate may use the tilt information provided by the tilt sensor to adjust the how the roller skate 100A operates. For example, if the roller skate 100A is going up a steep hill, the processor may instruct the electric motor to lower the speed in exchange for more torque. If the roller skate 100A is going down a steep hill, and if the speed of the roller skate 100A (e.g., measured by the speed sensor) indicates that the roller skate 100A is starting to lose control (e.g., the measured speed is above a maximum speed set by the rider, or the speed is lower than the maximum speed but higher than a target speed indicated by a speed control switch 159 (see FIG. 11A) on a remote control 150 of the roller skate 100A), the processor may apply electric braking to the electric motor to reduce the speed of the roller skate 100A. The processor may instruct the electric motor to stop applying power (e.g., stop rotating), then rotate in an opposite direction (e.g., in reverse) as a way to apply electric braking, as an example. This is referred to as downhill braking assist function, which improves safety for the rider. The downhill braking assist function is performed automatically by the processor of the roller skate 100A without control (e.g. input from the remote control) from the rider, in some embodiments.

FIG. 6 illustrates a bottom view of the roller skate 100A. In the example of FIG. 6, a power switch 138 and input/output (I/O) ports 137 are formed at the bottom surface of the roller skate 100A. The power switch 138 is used to turn on or off the roller skate 100A. The I/O ports 137 includes one or more ports (e.g., connectors), such as a charging port for charging the battery (e.g., a rechargeable battery) of the roller skate 100A. The I/O ports 137 may also include a data port (e.g., USB port or the like) for maintenance. For example, the data port may be used to update the firmware running on the processor of the roller skate, or may be used for trouble shooting the roller skate.

Figure 9:
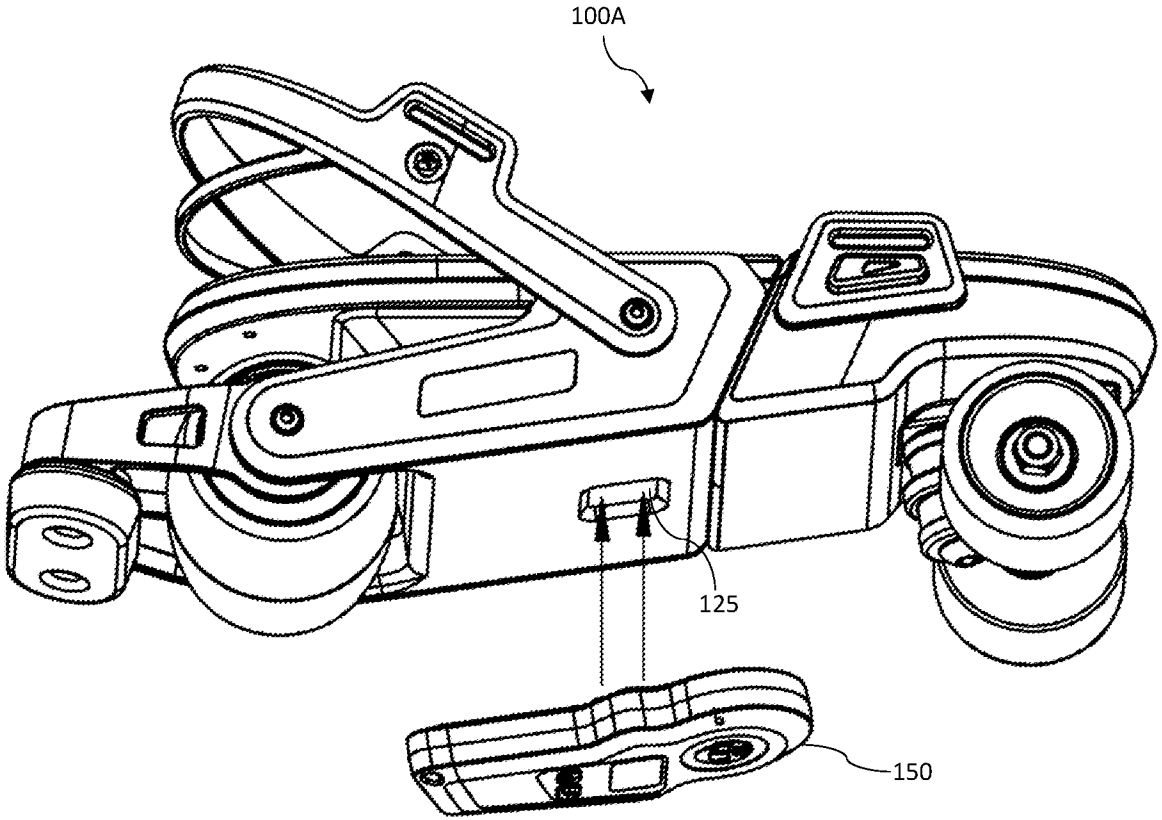

In FIG. 6, a battery 135 (e.g., a rechargeable battery) is illustrated in dashed lines. The battery 135 may be stored in an enclosure formed in the main body 111, and may not be visible in the bottom view of FIG. 6, thus shown in dashed lines. In addition, FIG. 6 illustrates a recess 125 in the bottom surface of the roller skate 100A (e.g., bottom surface of the rear main body 111B). In some embodiments, the recess 125 functions as a receptacle for storage of a remote control 150 (see FIGS. 11A-11C) of the roller skate 100A. The recess 125 has beveled edges for easy alignment with a protrusion 161 (see FIG. 11C) of the remote control 150. The dimensions (e.g., width, length, depth) of the recess 125 match those of the protrusion 161 of the remote control 150, such that the remote control 150 can be attached to the bottom of the roller skate 100A by clicking the protrusion 161 into the recess 125. FIG. 9 shows the attaching of the remote control 150 to the bottom of the roller skate 100A for storage.

FIG. 7A illustrates a perspective view of the bottom of the electric roller skate 100A, and FIG. 7B illustrates details of the front wheels 117 and the steering truck 121 of the electric roller skate 100A. As discussed above, the steering truck 121 allows for side-to-side flexing of the roller skate 100A, easier turning, and the ability for the roller skate to better perform the carving maneuver.

Figure 10:
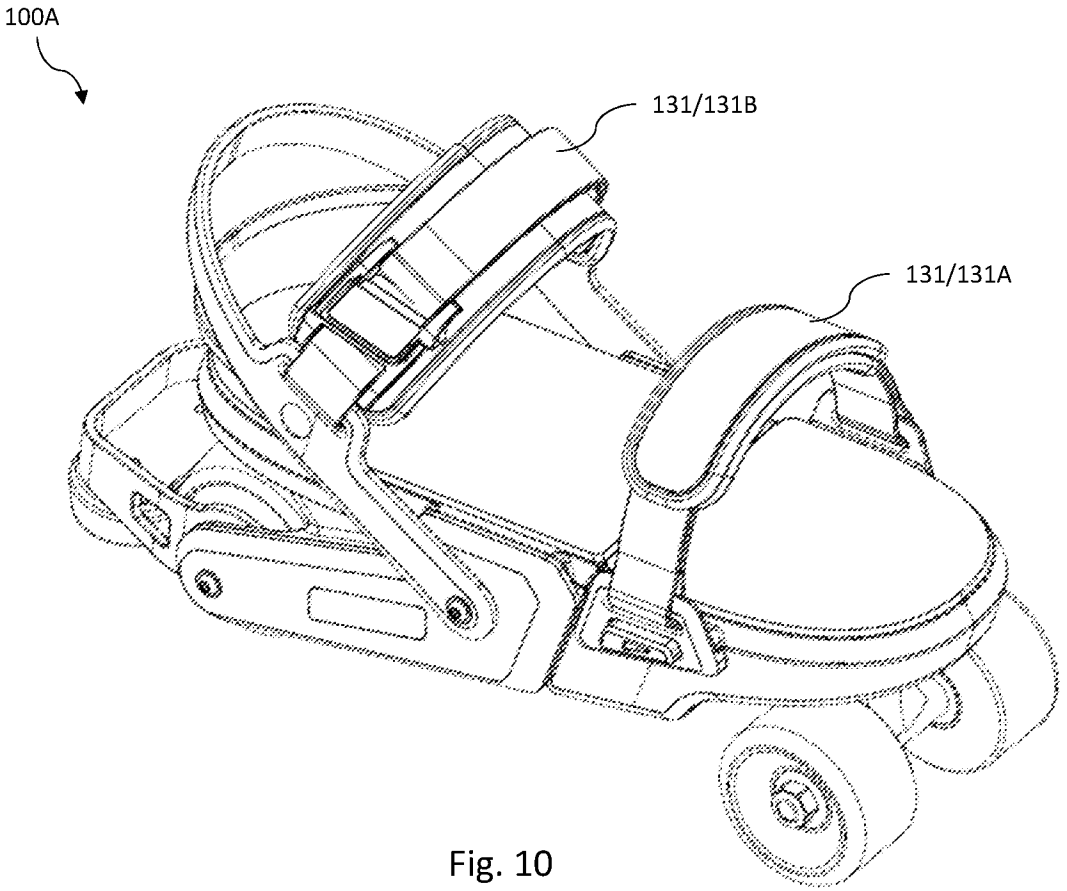

FIG. 10 shows a perspective view of the roller skate 100A with the toe strap 131A and the ankle strap 131B.

Figure 11B:
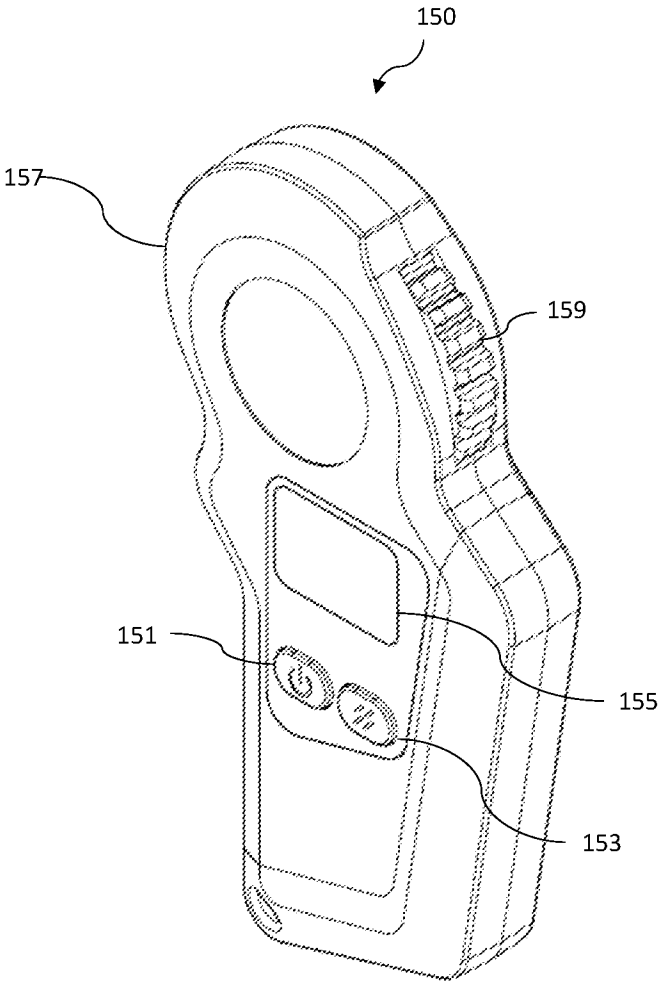
FIGS. 11A, 11B, and 11C illustrate different views of a remote control for the electric roller skate, in an embodiment.
Figure 11A:
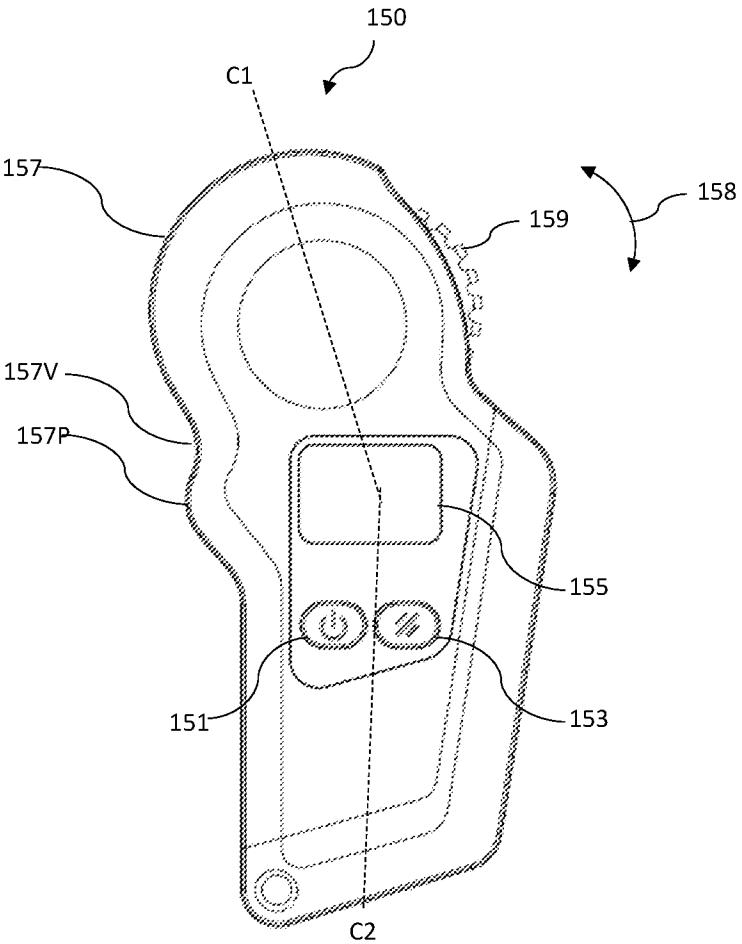
Figure 11C:
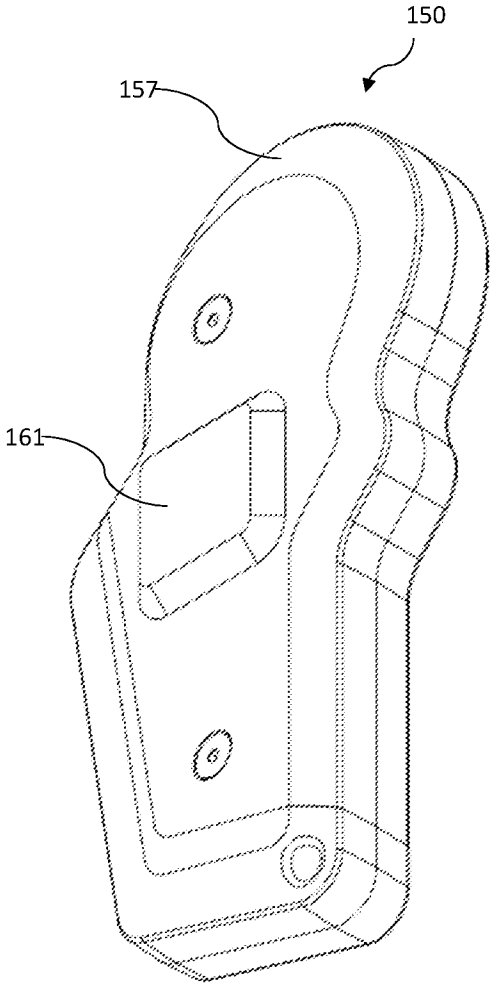
Figure 12:
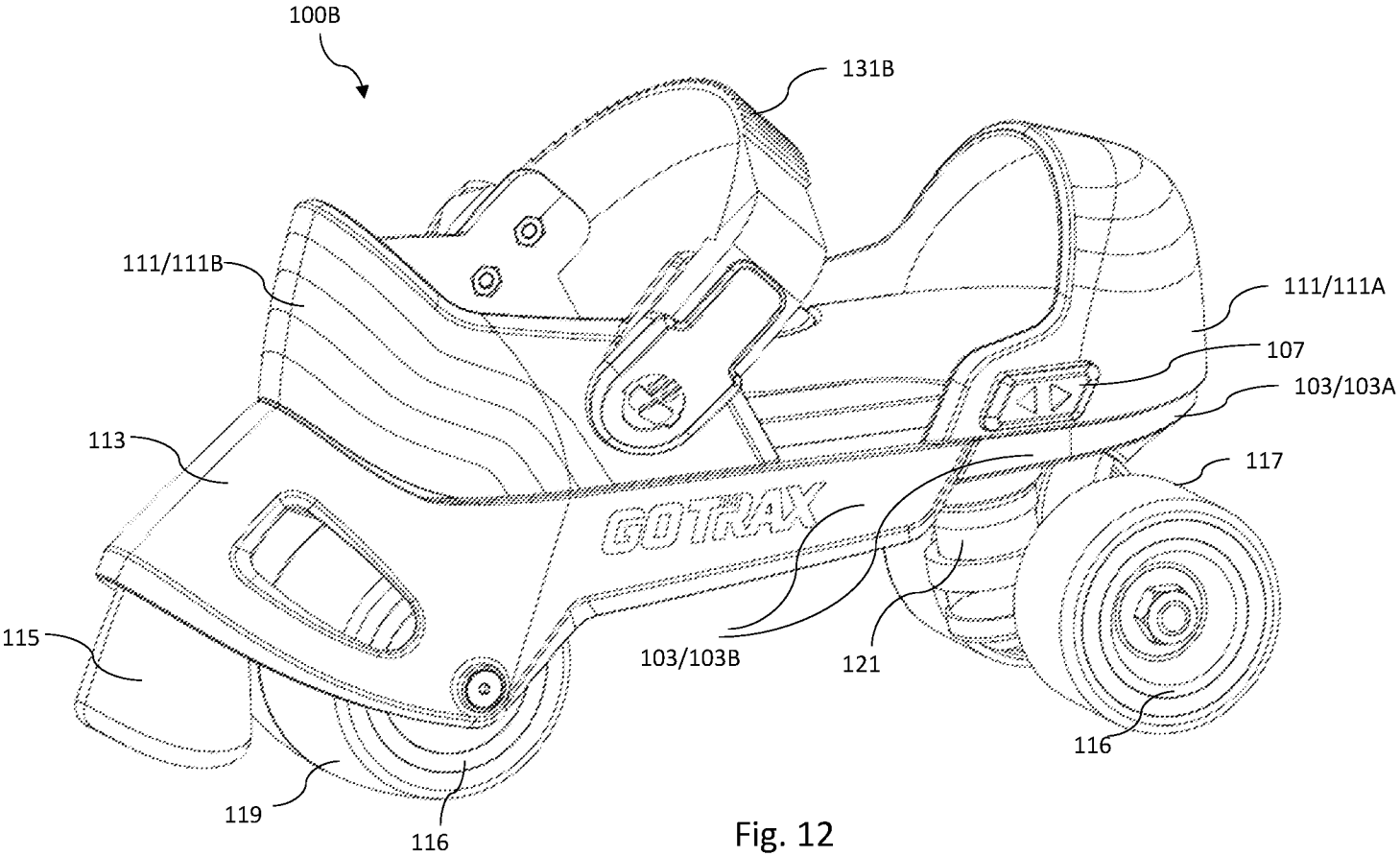
FIGS. 12-17 illustrate different views of an electric roller skate, in another embodiment.
Figure 13:
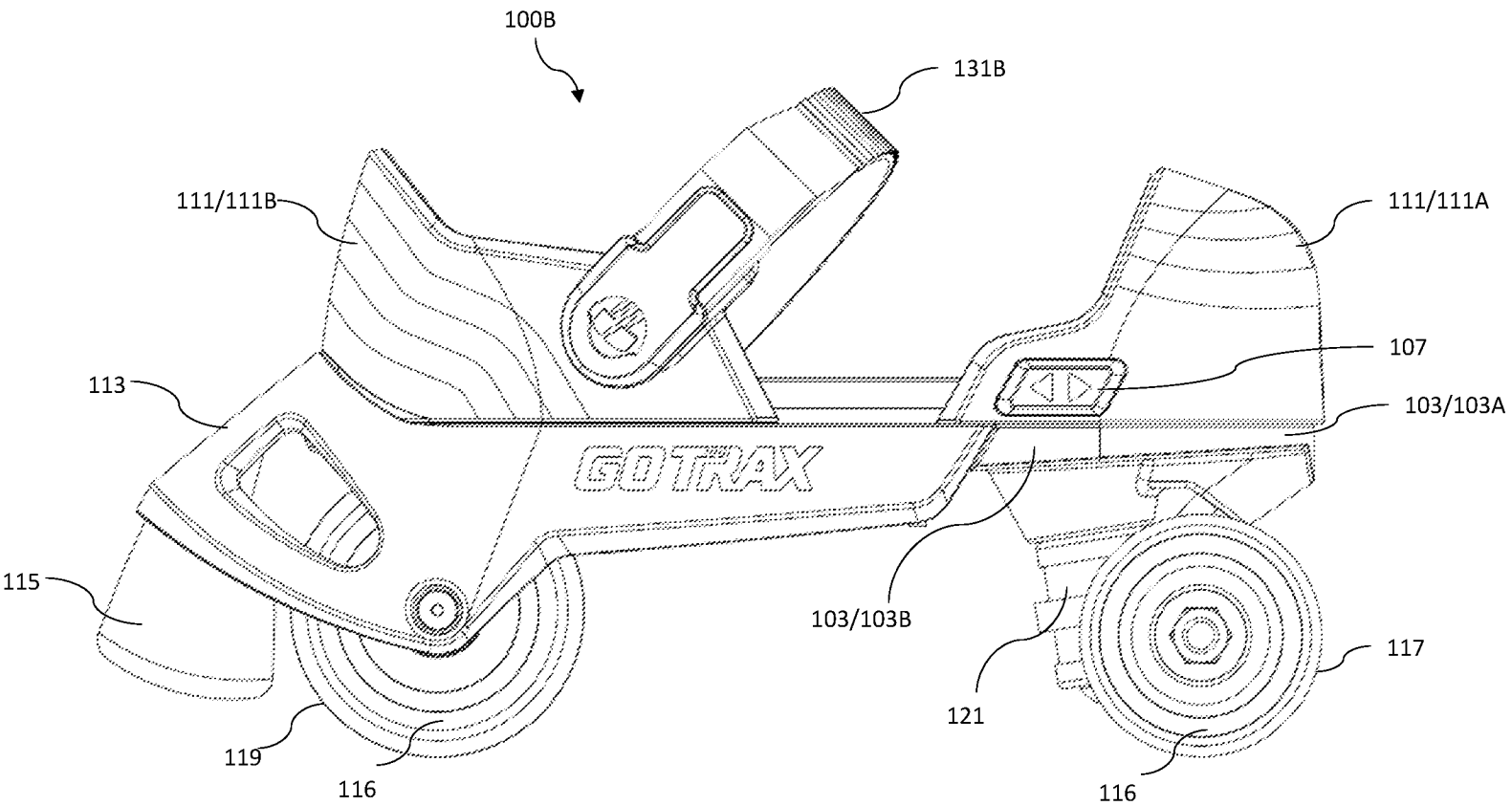
Figure 14:
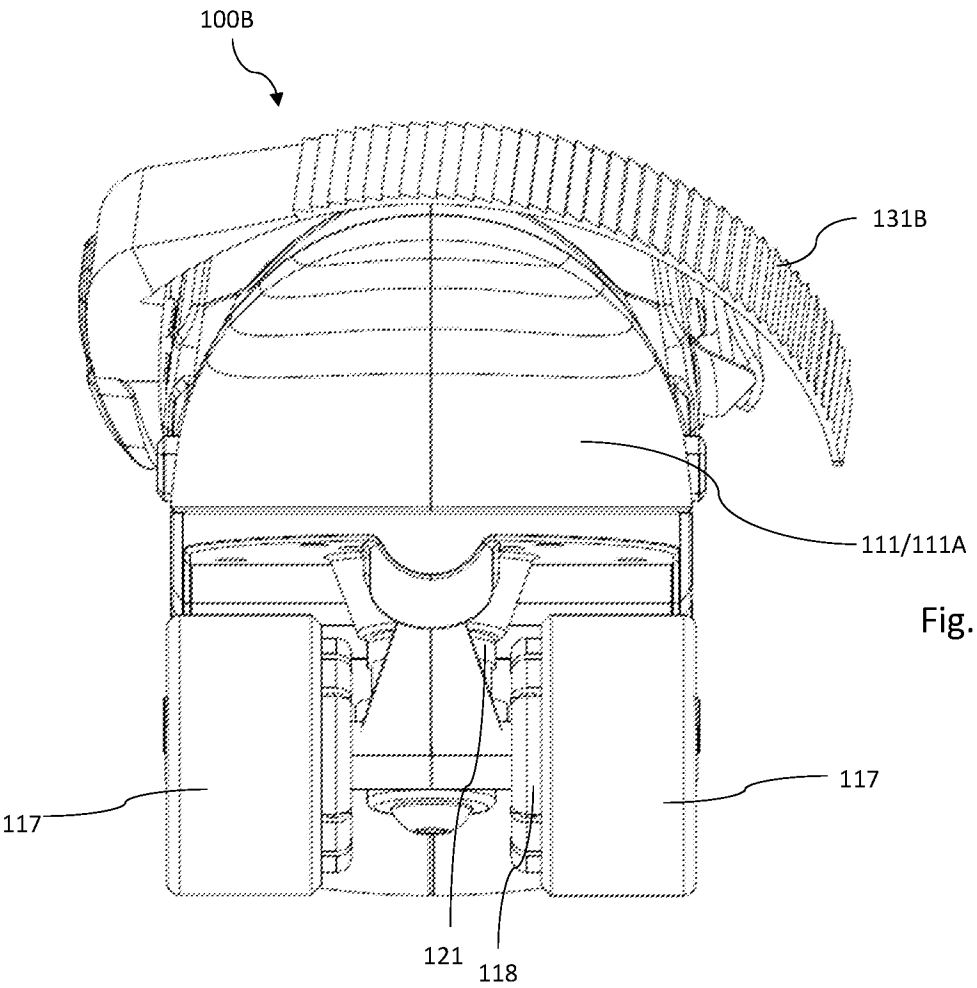
Figure 15:
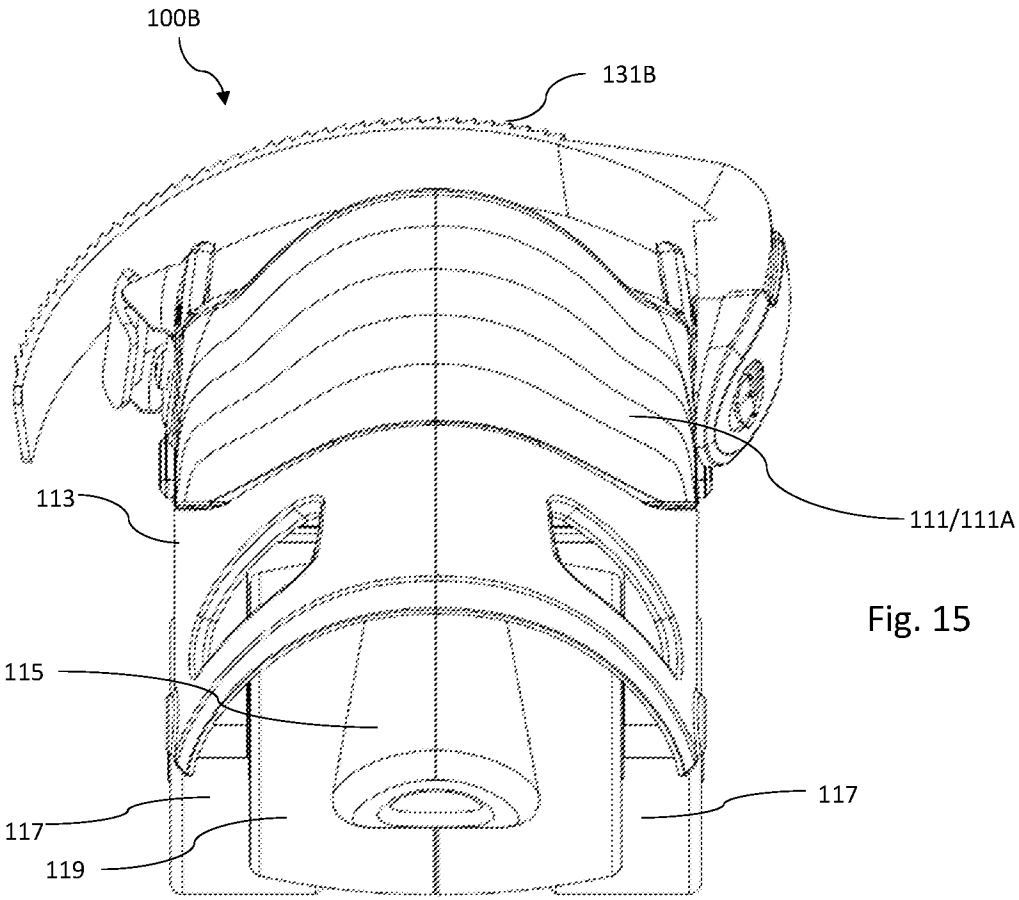
Figure 16:
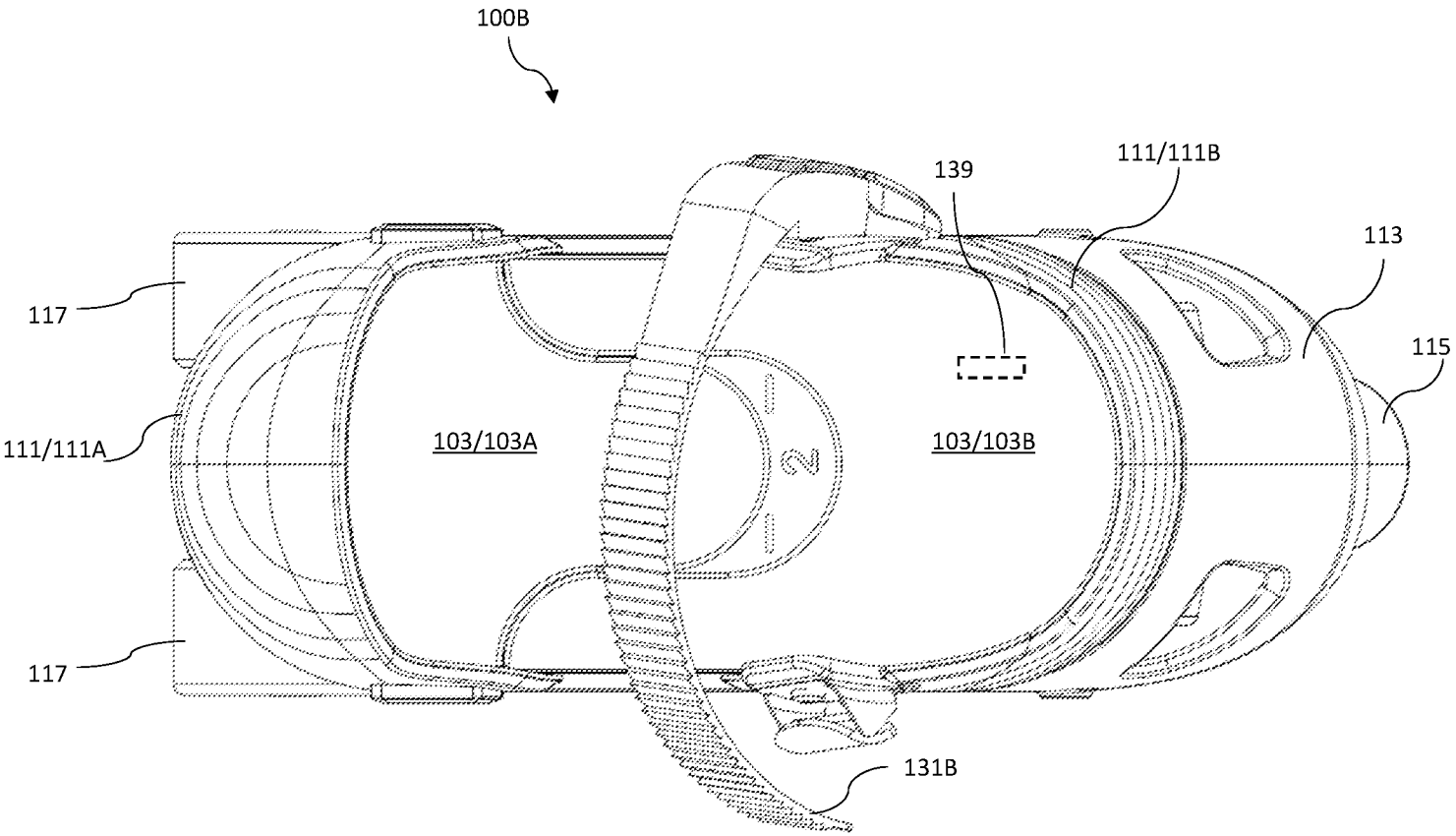
Figure 17:
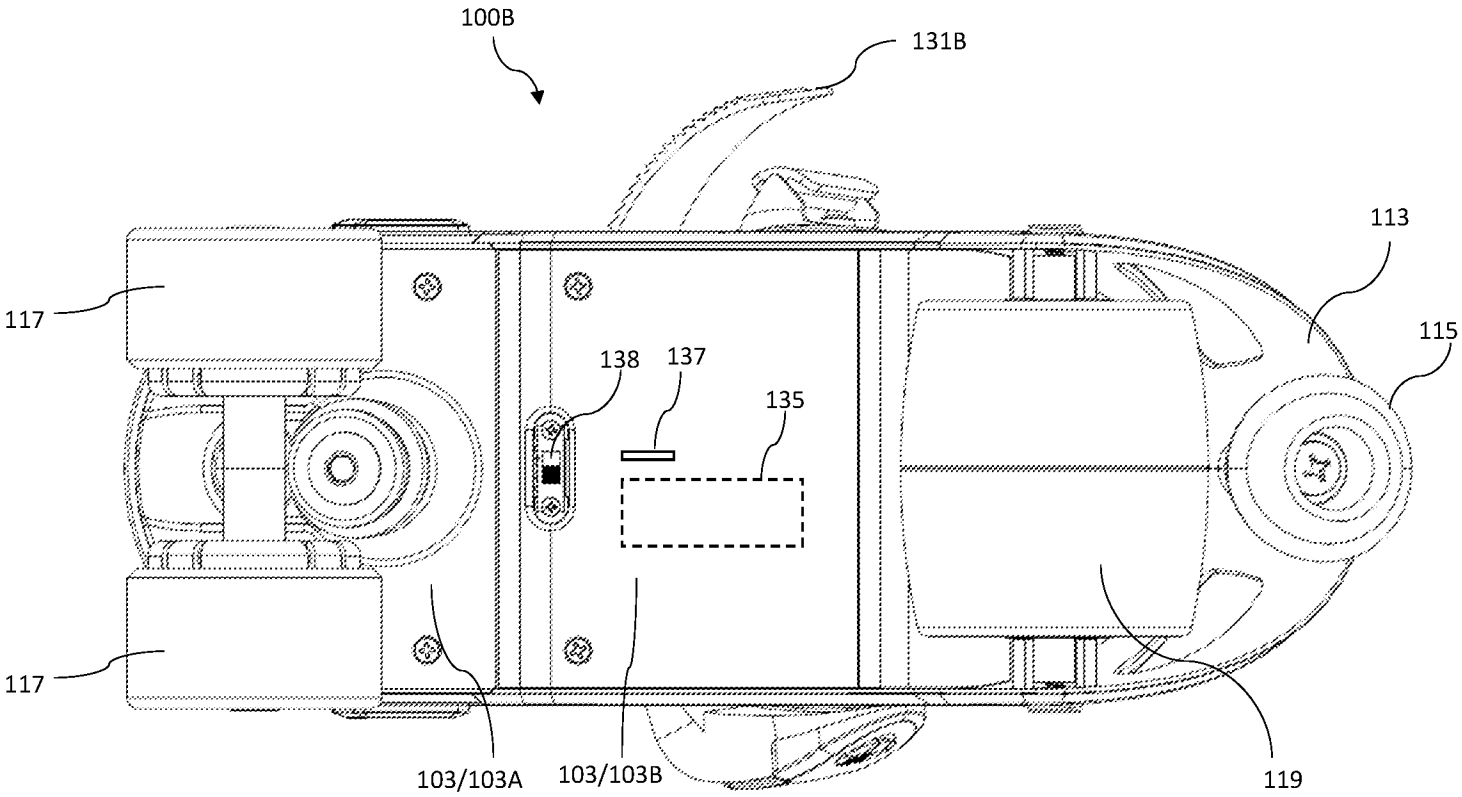

FIG. 11A illustrates a front view of a remote control 150 for the roller skate 100A. FIGS. 11B and 11C illustrate perspective views of the remote control 150 from the front side and from the backside, respectively. As illustrated in FIGS. 11A-11C, the remote control has a housing 157 (also referred to as an enclosure, or a shell). The front side of the remote control 150 has a plurality of control buttons, such as a power button 151 and a mode selection button 153, and has a display 155 (e.g., a liquid-crystal display (LCD)). The power button 151 is used to turn on or off the remote control 150. The mode selection button 153 is used to select different modes or settings for the electric roller skate system. For example, the mode selection button 153 may toggle through different modes or settings for the rider to select different operation modes (e.g., normal operation mode or calibration mode) or settings (e.g., maximum speed setting).

The remote control 150 also has a speed control switch 159, which is a dial that is partially exposed by the housing 157. The speed control switch 159 may be turned in both directions as illustrated by the double arrowed line 158 in FIG. 11A. When selecting the operation mode or setting values for different settings, the speed control switch 159 may be turned to increase/decrease the values for the settings, or to select different modes or options. When the rider rides the roller skate 100A in the normal operation mode, the rider holds the remote control 150 in his/her hand. By turning the speed control switch 159 in one direction, the forward speed of the roller skate 100A can be gradually increased, where forward speed refers to the speed of the roller skate when the roller skate is traveling in the direction pointed to by the front base 103A. Similarly, by turning the speed control switch 159 in another (opposing) direction, the backward speed of the roller skate 100A can be gradually increased, where backward speed refers to the speed of the roller skate when the roller skate is traveling in the direction pointed to by the rear base 103B. In other words, the roller skate 100A can be powered by the electric motor to move forward or backward at a speed controlled (e.g., set) by the rider through the remote control 150.

In some embodiments, the speed control switch 159 is spring-loaded, and has a neutral position when not being turned by the rider. In other words, when the rider is not turning the speed control switch 159, the spring in the remote control 150 causes the speed control switch 159 to automatically go back to the neutral position. In some embodiments, during the normal operation mode, when the speed control switch 159 is at the neural position, the electric motor is turned off and not driving the rear wheel 119. When the speed control switch 159 is turned away from the neutral position, the electric motor is turned on and provides power assist to drive the rear wheel 119. Depending on which direction (see double arrowed line 158 in FIG. 11A) the speed control switch 159 is turned, the electric motor may drive the roller skate 100A to go forward or backward.

In some embodiments, the rotational speed of the electric motor can be adjusted continuously, or in a plurality of discrete steps, within a pre-determined range. The pre-determined range may be between zero and a maximum rotational speed of the electric motor (or an equivalent maximum linear speed of the roller skate) set by the rider. The rider can gradually increase the speed of the roller skate by gradually turning the speed control switch 159 away from the neutral position. In other words, the position of the speed control switch 159 corresponds to a target speed for the electric motor. The electric motor adjusts its rotational speed in response to the position of the speed control switch 159. In some embodiments, as a safety feature, the rotational speed of the electric motor is limited to a maximum speed set by the rider, or a default maximum speed set at the factory.

The center axis C1 (see FIG. 11A) of the upper portion of the housing 157 and the center axis C2 of the lower portion of the housing 157 form an angle. The side surfaces of the housing 157 are curvy, and includes a peak 157P and a valley 157V. The rider's thumb may rest on the speed control switch 159, the index finger of the rider may wrap around the valley 157V, with other fingers of the rider wrapping around the lower portion of the remote control 150 below the peak 157P. These ergonomic design features allow for a tight, secure, yet comfort grip of the remote control 150 with little fatigue for the rider's hand.

FIG. 11C shows the protrusion 161 at the backside of the remote control 150. As discussed above, when the roller skate 100A is not in use, the remote control 150 can be conveniently stored by clicking the protrusion 161 of the remote control 150 into the recess 125 at the bottom of the roller skate 100A. Besides the illustrated embodiment, other ways for storing the remote control 150 are also possible and are fully intended to be included within the scope of the present disclosure. For example, the enclosure in the main body 111 of the roller skate 100A may have a dedicated compartment that can be used to store the remote control 150.

FIGS. 12-17 illustrate different views of a roller skate 100B, in another embodiment. The roller skate 100B is similar to the roller skate 100A, with the same or similar reference numerals representing the same or similar components. The discussion hereinafter focuses on some of the differences between the roller skate 100B and the roller skate 100A.

As shown in FIGS. 12-17, the main body 111 of roller skate 100B includes two parts, a front main body 111A and a rear main body 111B, which are both disposed above the base 103. The platform 101 on top of the base 103 in the roller skate 100A is omitted in the roller skate 100B. The base 103 (e.g., 103A and 103B) of the roller skate 100B may be formed of a less expensive material, such as plastics. The rear base 103B of the roller skate 100B may include a portion that extends downward (e.g., toward the ground) and backward. The brake bracket 113 may be integrated in (e.g., implemented as) the backward extending portion of the rear base 103B.

Note that the shape of the front main body 111A and the shape of the rear main body 111B of the roller skate 100B contour (e.g., follow) the shape of a shoe, thus only the ankle strap 131B is used in the roller skate 100B, and the toe strap 131A of the roller skate 100A is omitted. The rear wheel 119 of the roller skate 100B is attached to the downward extending portion of the rear base 103B. LEDs 116 are formed around the wheels (e.g., 117, 119) of the roller skate 100B.

The remote control for the roller skate 100B may be the same as or similar to the remote control 150. The remote control for the roller skate 100B may be stored in a dedicated storage compartment in the rear base 103B, or may be simply clipped onto the ankle strap 131B when not in use. The roller skate 100A may be more durable and more complex, and may be suitable for adult riders, while the roller skate 100B may be lighter and simpler, and may be suitable for young kids.

Figure 18:
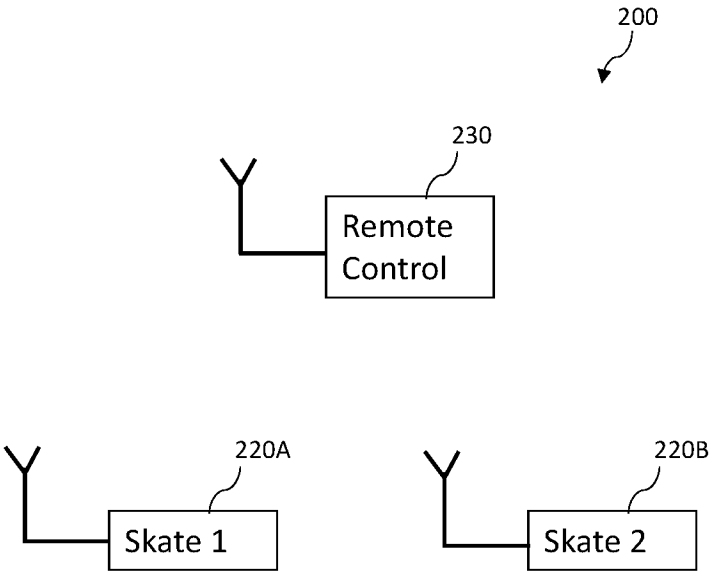
FIG. 18 illustrates a block diagram of an electric roller skate system, in an embodiment.

FIG. 18 illustrates a block diagram of an electric roller skate system 200, in an embodiment. The electric roller skate system 200 includes a remote control 230, a roller skate 220A, and a roller skate 220B. Each of the remote control 230, the roller skate 220A, and the roller skate 220B includes an antenna and a radio frequency (RF) circuit that enable wireless communication (e.g., through the Bluetooth wireless protocol or any other suitable wireless communication protocol) among the remote control 230, the roller skate 220A, and the roller skate 220B. In particular, the roller skate 220A and the roller skate 220B not only could communicate with the remote control 230, but also could communicate with each other. The remote control 230 may correspond to the remote control 150 discussed above. The roller skate 220A and the roller skate 220B may correspond to a pair of roller skate 100A, or a pair of roller skate 100B.

Figure 19:
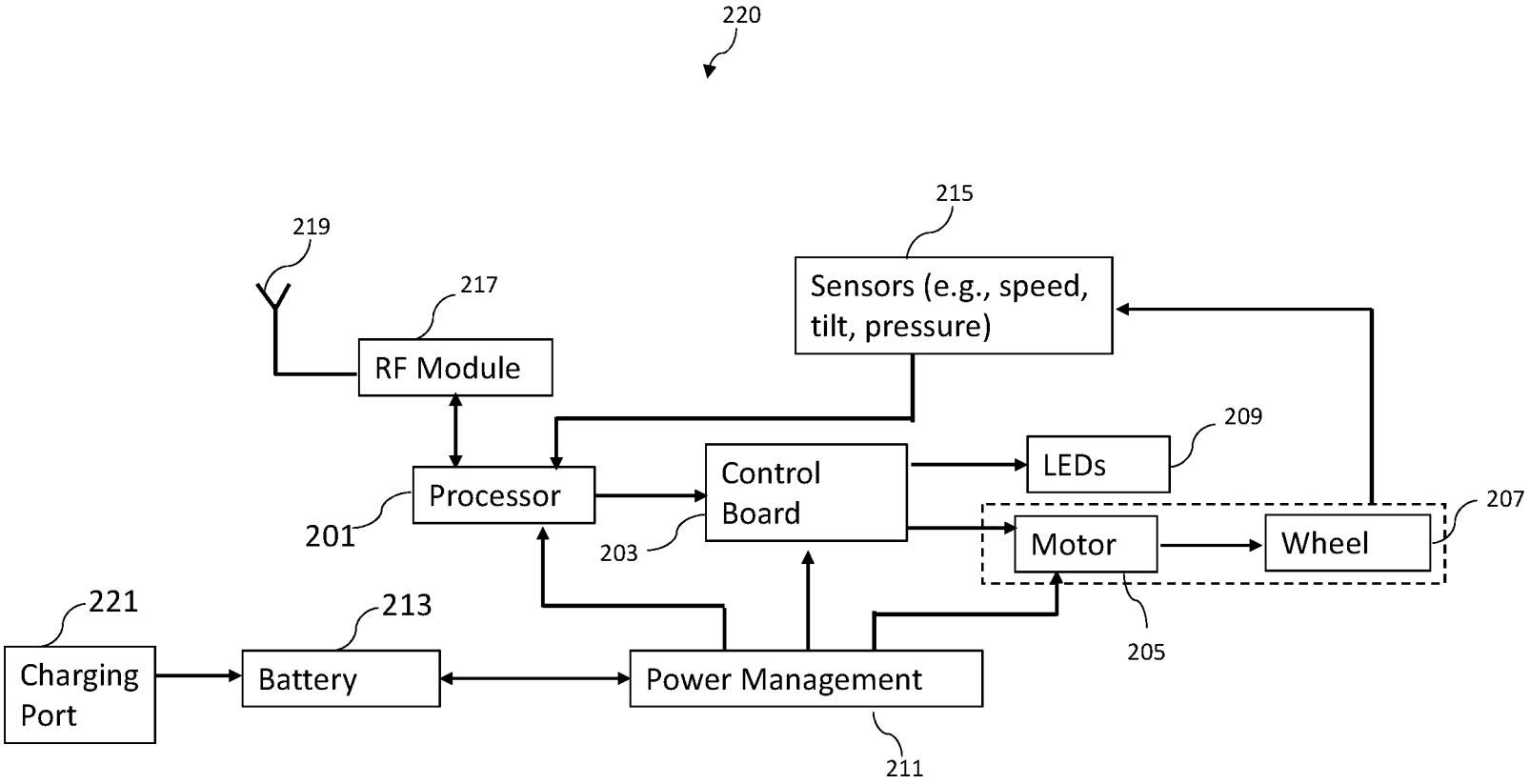
FIG. 19 illustrates a block diagram of an electric roller skate, in an embodiment.

FIG. 19 illustrates a block diagram of a roller skate 220, in an embodiment. The roller skate 220 may correspond to one of the roller skates 200 (e.g., 220A and 220B) in FIG. 18. In other words, the roller skate 220 may correspond to the roller skate 100A or the roller skate 100B. For ease of discussion, the roller skate 100A and the roller skate 100B are collectively referred to as roller skate 100. Note that for simplicity, not all features of the roller skate 220 are illustrated.

In FIG. 19, the roller skate 220 includes a processor 201, a control board 203, a motor 205, a wheel 207, and LEDs 209. The wheel 207 corresponds to the rear wheels 119 of the roller skate 100. The motor 205 correspond to the electric motors that drive the rear wheels 119 of the roller skate 100. The LEDs 209 correspond to the LEDs 116 of the roller skate 100.

The roller skate 220 further includes a plurality of sensors 215 (see, e.g., 139 in FIG. 5), such as a pressure sensor(s), a tilt sensor, and a speed sensor. The various types of sensors send sensor data (e.g., outputs from the sensors) to the processor 201. Additionally, the roller skate 220 includes a battery module 213, a power management module 211, and a charging port 221.

The processor 201 may be a micro-processor, a micro-controller, a central processing unit (CPU), or the like. The processor 201 receives sensor data from the plurality of sensors, processes the sensor data, and generates control signals to control operation of the roller skate 220. The control board 203 includes circuits (e.g., driver circuits) for processing the control signals from the processor 201 and generating driving signals (e.g., voltage signals or current signals) for the motor 205 and the LEDs 209. In some embodiments, the processor 201 is integrated into the control board 203. The motors 205 drives the wheel 207 to rotate in the direction and the rotational speed specified by the control signals from the processor 201.

The battery module 213 is a rechargeable battery, such as a lithium-ion recharge battery pack or other suitable rechargeable battery pack. The power management module 211 generates (e.g., derives) a plurality of supply voltages with different values from the battery module 213 to power different components/circuits of the roller skate 220. The power management module 211 may include a plurality of switched-mode power supply (SMPS) systems, such as Buck converters, Buck-Boost converters, or the like. The charging port 221 is used for charging the battery module 213, and may correspond to one of the ports in the I/O ports 137.

The roller skate 220 further includes an antenna 219 and an RF module 217. The RF module 217 includes circuits for wireless communication among the roller skate 220A, the roller skate 220B, and the remote control 230 of the electric roller skate system 200. The RF module 217 may be, e.g., a Bluetooth wireless module or any other suitable wireless communication modules (e.g., based on other wireless communication protocols).

In some embodiments, during the normal operation mode, when the rider selects a speed for the roller skates 220A and 220B (e.g., by pushing the speed control switch 159 of remote control 150 to a desired position), the processor 201 sends a control signal to the control board 203, and the control board 203 generates a corresponding driving signal to instruct the electric motor in each of the roller skates 200A and 200B to rotate at a corresponding target rotational speed. To ensure that the electric motor is rotating at the target rotational speed, closed-loop control may be used by monitoring (e.g., by the processor 201) the measured rotational speed from the speed sensor and adjusting (e.g., increasing or decreasing) the driving voltage or driving current supplied to the electric motor, until the measured speed is at the target rotational speed. The measurement from the speed sensor in each roller skate, however, may not give the correct measurement value and may deviate from the correct measurement value by a certain percentage, due to, e.g., quality variation in production, temperature shift, component aging, and so on. Under the closed-loop control, the motors for both roller skates 220A and 220B may rotate at different speeds due to the different error margins in the measured speed values.

One of the advantages of the electric roller skate system 200 is that the rider can put both feet on the ground in a relaxed position and let the electric motors provide driving power to move the rider. However, if the electric motors for both roller skates 220A and 220B are not turning at the same speed set by the rider, the rider may not be able to go straight forward, and may have to constantly adjust the direction of travel. To solve this issue, a calibration process may be performed for the speed sensors to compensate for the differences between measurements from the speed sensors, and a fitting curve generated by the calibration process may be used in the normal operation mode to ensure that both electric motors are rotating at the same rotational speed. Details are discussed hereinafter.

Figure 20:
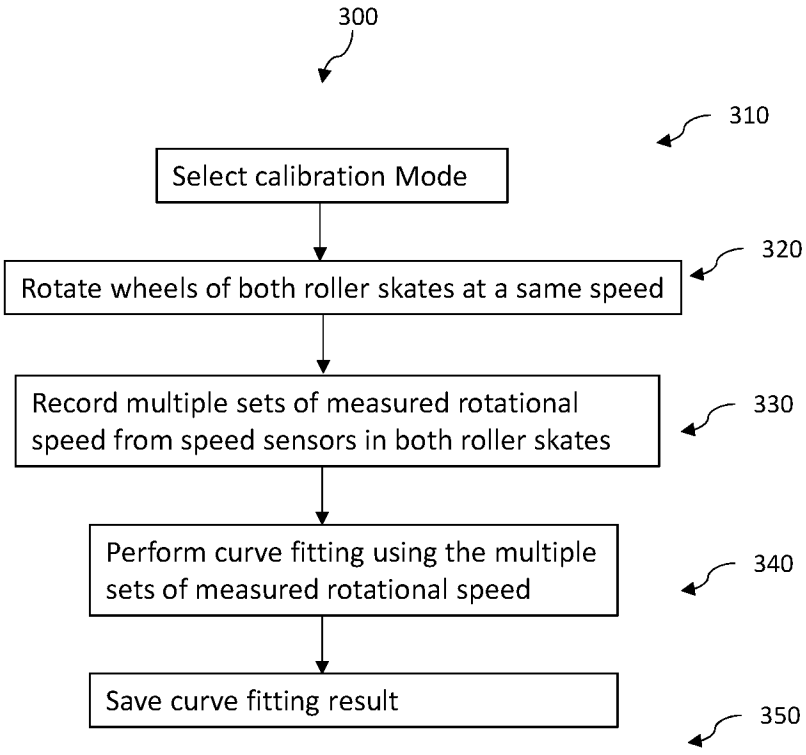
FIG. 20 illustrate a method of performing a calibration process for the electric roller skate system, in an embodiment.

FIG. 20 illustrate a method 300 of performing a calibration process for the electric roller skate system, in an embodiment. It should be understood that the example method shown in FIG. 20 is merely an example of many possible example methods. One of ordinary skill in the art would recognize many variations, alternatives, and modifications. For example, various steps as illustrated in FIG. 20 may be added, removed, replaced, rearranged, or repeated.

Referring to FIG. 20, at block 310, the calibration mode is selected, e.g., by selecting the calibration mode using the remote control (see, e.g., 150 in FIG. 11A, or 230 in FIG. 18). At block 320, the wheels of both roller skates (e.g., 220A, 220B in FIG. 18) coupled to the speed sensors are rotated at the same speed. This may be achieved in different ways. For example, the user may hold both roller skates, and press the wheels (e.g., the rear wheels 119 with speed sensors) of both roller skates against another rotating object. Due to friction with the rotating object, both wheels rotate at the same speed. As another example, the user may hold both roller skates, press the wheels of the roller skates on the ground, and move both roller skates at the same speed. In block 330, the outputs of the speed sensors (e.g., the measured rotational speeds) are recorded. The user may press a button (e.g., 153 in FIG. 11A) on the remote control 150 to instruct each of the roller skates to record its respective measured rotational speed at the time when the button is pressed. The processor 201 in each roller skate may store the measured rotational speed locally in a memory region of the processor 201. The above process may be repeated a few times at different speeds (e.g., by changing the rotational speed of the rotating object), such that multiple sets of measured rotational speed are recorded, where each set of the measured rotational speed includes a first measured rotational speed from a first speed sensor in a first roller skate (e.g., 220A), and includes a second measured rotational speed from a second speed sensor in a second roller skate (220B).

Next, in block 340, a curve fitting process is performed using the multiple sets of measured rotational speed to generate a fitting curve. The users may start the curve fitting process by turning the speed control switch 159 during the calibration mode. Details of the curve fitting process are discussed hereinafter with reference to FIG. 21. In some embodiments, the curve fitting process finds an optimum or near-optimum fitting curve for the multiple sets of measured rotational speed. The fitting curve indicates a one-to-one mapping between the measured rotational speeds from the two speed sensors in the two roller skates.

Next, in block 350, the curve fitting result (e.g., the fitting curve) is saved for later use, e.g., for use in the normal operation mode. The fitting curve may be saved automatically after the curve fitting process is completed. The user may then exit the calibration mode using the remote control 150.

Figure 21:
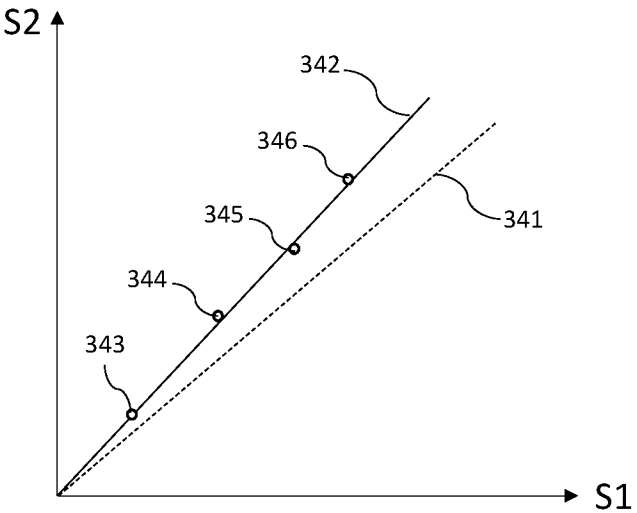
FIG. 21 illustrates a curve fitting process performed in the calibration process of FIG. 20, in an embodiment.

FIG. 21 illustrates a curve fitting process performed in the calibration process of FIG. 20, in an embodiment. In FIG. 21, the x-axis represents measured rotational speed from the first speed sensor in the first roller skate (e.g., 220A), and the y-axis represents measured rotational speed from the second speed sensor in the second roller skate (e.g., 220B). Each set of measured rotational speed is plotted as a dot in FIG. 21.

The dashed line 341 with a 45-degree angle in FIG. 21 represents the ideal case where the measured rotational speeds from both sensors match each other.

In the example of FIG. 21, the sets of measured rotational speed are plotted as dots (e.g., dots 343, 344, 345, and 346). The curve fitting process uses a liner curve fitting to find a fitting curve 342 (e.g., a line) that fits the sets of measured rotation speed. Linear curve fitting is merely a non-limiting example. The curve fitting process may use any suitable fitting curve process, such as a high-order polynomial curve fitting process to fit data points that form complicated curve shapes other than liner lines, as skilled artisans readily appreciate. In some embodiments, the curve fitting is performed for rotational speeds within a pre-determined speed range. In other words, the curve fitting process is performed for a range of speed that is suitable for roller skate applications (e.g., corresponding to a linear speed between 0 mile per hour to about 15 miles per hour), in some embodiments. The fitting curve generated by the curve fitting process may be saved in the memory region of the processor 201 as the coefficients of the fitting polynomial (e.g., the polynomial used for curve fitting), or may be saved as a look-up table (LUT) that shows the one-to-one mapping between the measured rotational speeds from the two speed sensors in the two roller skates at a plurality of rotational speeds.

In some embodiments, during the calibration mode, each of the roller skates stores its measured data (e.g., measurements of rotational speed during calibration) locally. To perform the curve fitting process, the stored measurement data from both roller skates need to be combined together to form the multiple sets of measured rotational speed. This may be achieved by transferring the stored measurement data from one of the roller skate (e.g., 220B) to the other roller skate (e.g., 220A). As discussed above, the roller skates 220A and 200B have RF modules 217 that allow for wireless communication between the roller skates. The processor 201 in the roller skate (e.g., 220A) having the stored measurement data from both roller skates performs the curve fitting process. In some embodiments, after the curve fitting process is completed, the result of the curve fitting process (e.g., the fitting curve) is sent from the roller skate (e.g., 220A) performing the curve fitting process to the other roller skate (e.g., 220B) and saved in the memory region of the processor 201 of the other roller skate (e.g., 220B). The fitting curve will be used by the other roller skate (e.g., 220B) to adjust its target rotational speed during normal operation mode, details of which are discussed below with reference to FIG. 22.

Figure 22:
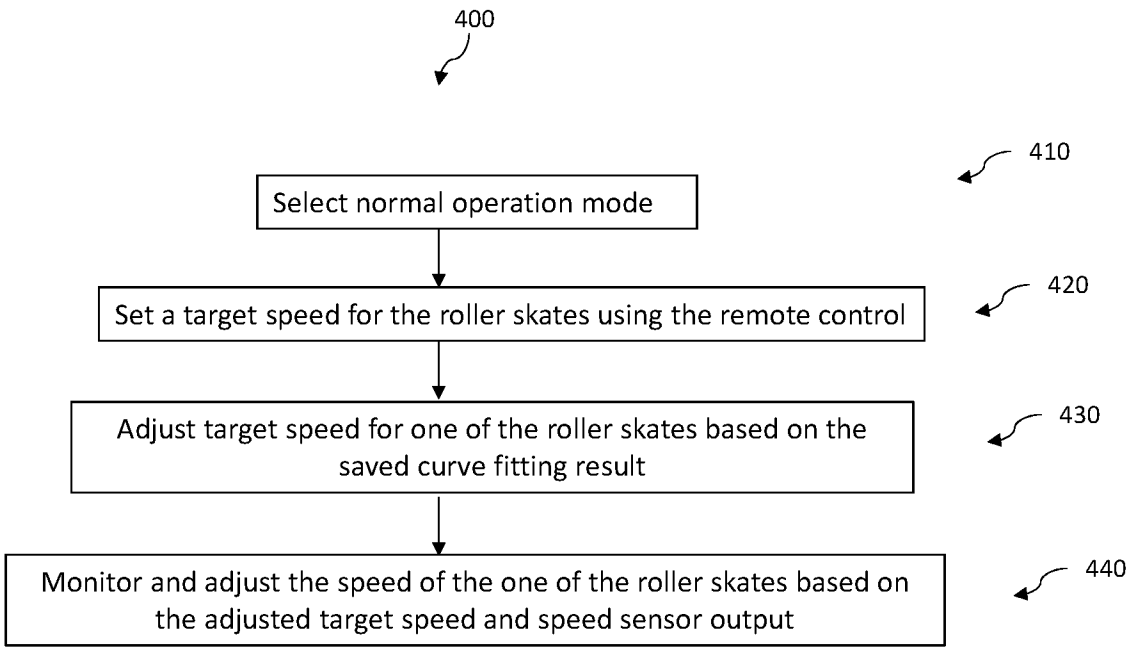
FIG. 22 illustrate a method of applying the results obtained in the curve fitting process in the normal operation of the electric roller skate system, in an embodiment.

FIG. 22 illustrate a method of using the result of the curve fitting process in the normal operation mode of the electric roller skate system, in an embodiment. It should be understood that the example method shown in FIG. 22 is merely an example of many possible example methods. One of ordinary skill in the art would recognize many variations, alternatives, and modifications. For example, various steps as illustrated in FIG. 22 may be added, removed, replaced, rearranged, or repeated.

Referring to FIG. 22, at block 410, the normal operation mode is selected, e.g., by selecting the normal operation mode using the remote control 230. At block 420, a target speed for the roller skates (e.g., 220A, 220B) is set, e.g., by the rider pushing the speed control switch 159 to a desired position that corresponds to the target speed. The selected target speed is sent from the remote control 230 to the roller skates 220A and 220B through the RF modules. At block 430, the target speed for one of the roller skates is adjusted based on the saved curve fitting result (e.g., the fitting curve). For example, following the curve fitting example discussed above with reference to FIG. 21, the roller skate 220B corresponds to the "one of the roller skates" of block 430. Therefore, the processor 201 of the roller skate 220B locates a data point on the fitting curve that has an x-axis value equal to the target speed, and uses the y-axis value of that data point as the adjusted target speed for the roller skate 220B. In block 440, the speed of the one of the roller skates is monitored and adjusted (e.g., through closed-loop control) based on the adjusted target speed and the speed sensor output. In other words, the closed-loop control will try to maintain the rotational speed of the one of the roller skates (e.g., 220B) at the adjusted target speed (instead of the original target speed). Although not shown in FIG. 22, skilled artisans will readily appreciate that the target speed for the other one of the roller skates (e.g., 220A) is not adjusted, and uses the original target speed (e.g., from the remote control) as its target speed.

Note that the above calibration process result, when used as illustrated in FIG. 22, will allow the wheels of both roller skate 220A and 220B to rotate at a same speed, so that the rider can put both feet on the ground and move in a straight line. The actual rotational speed of the electric motors, however, may deviate from the target speed selected by the remote control by a small percentage, which is not a problem since such deviation is normally small, and the rider can always adjust the speed further up or down by pushing the speed control switch 159 further, until the roller skates are moving at a desired speed.

Figure 23:
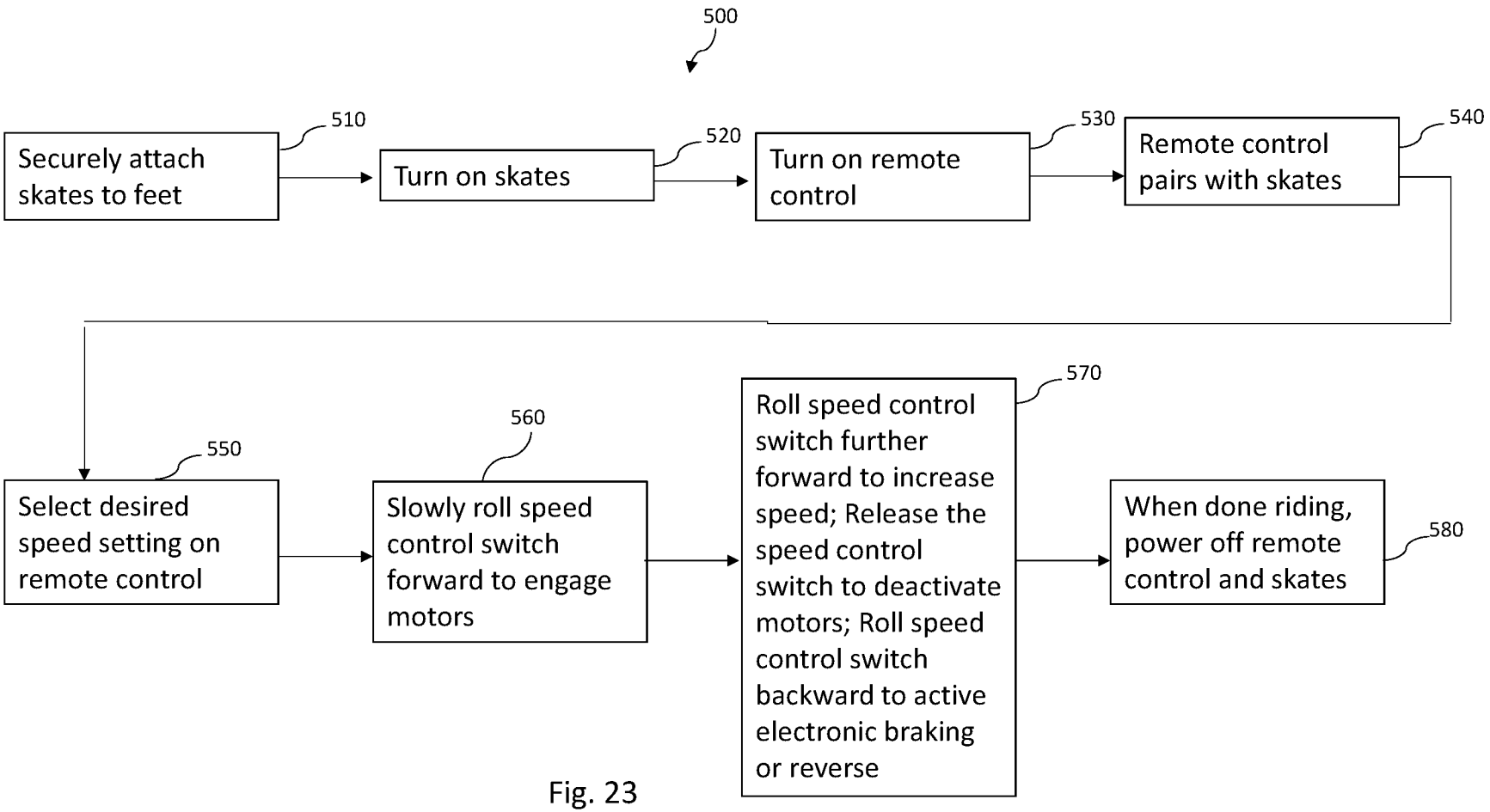
FIG. 23 illustrates a method of operating the electric roller skate system, in an embodiment.

FIG. 23 illustrates a method 500 of operating the electric roller skate system, in an embodiment. It should be understood that the example method shown in FIG. 23 is merely an example of many possible example methods. One of ordinary skill in the art would recognize many variations, alternatives, and modifications. For example, various steps as illustrated in FIG. 23 may be added, removed, replaced, rearranged, or repeated.

Referring to FIG. 23, at block 510, the roller skates are attached securely to the feet of the rider, e.g., by adjusting the size of the bases 103 and tying the shoes of the rider with the roller skates using the straps (e.g., toe strap, ankle straps). At block 520, the roller skates are turned on, e.g., by pushing or sliding the power switch 138 to the ON position. At block 530, the remote control is turned on, e.g., by pressing the power button 151 on the remote control. At block 540, the remote control pairs (e.g., establishes communication) with the roller skates, e.g., via the RF modules. At block 550, the rider selects a desired speed setting on the remote control for the roller skates. The desired speed setting may be, e.g., a maximum speed. The electric motor will provide power to drive the roller skates to move at or below this maximum speed. The rider can use the speed control switch 159 to adjust the speed of the roller skates, as long as the speed of the roller skates is below this maximum speed. At block 560, the rider can slowly roll the speed control switch forward (or backward) away from the neutral position to engage the electric motors. At block 570, the rider can adjust the speed and direction of the roller skates using the remote control. For example, roll the speed control switch further forward to increase speed; release the speed control switch (which is spring-loaded) to its neutral position to deactivate the electric motors; or roll the speed control switch backward to activate electric braking, or to move the roller skates backward (e.g., in reverse). As discussed above, the target speed indicated by the position of the speed control switch 159 may be adjusted (e.g., modified) using the fitting curve to find an adjusted target speed for one of the roller skates, while the other roller skate uses the target speed indicated by the position of the speed control switch 159. At block 580, when done riding, the rider powers off the remote control and the roller skates.

Variations and modifications to the disclosed embodiments are possible and are fully intended to be included within the scope of the present disclosure. For example, the curving fitting process may be performed by a processor in the remote control, after both roller skates send their measurement data to the remote control for the curve fitting processing. As another example, the curve fitting results (e.g., the fitting curve) may be send to the remote control. In the normal operation mode, the remote control may send the target speed indicated by the position of the speed control switch to the first roller skate (e.g., 220A), and send the adjusted target speed (e.g., adjusted using the fitting curve) to the second roller skate (e.g., 220B). As yet another example, during the calibration mode, if the true rotational speed is known and stored each time the measured rotational speeds are stored, then two sets of measurement data can be formed, where each set of measurement data includes pairs of the true rotational speed and the corresponding measured rotational speed of a speed sensor (in the roller skate 220A or 220B). The curve fitting process discussed above can be performed for each of the two sets of measurement data, and two fitting curves can be obtained. Each fitting curve gives the one-to-one correspondence between the target speed (e.g., the true speed) and the corresponding measured rotational speed from the sensor of the corresponding roller skate. The fitting curve can then be used in the normal operation mode to find the adjusted target speed for the corresponding roller skate. In other words, each roller skate will use a different adjusted target speed calculated based on the corresponding fitting curve and the target speed indicated by the position of the speed control switch 159. Using two different adjusted target speeds as discussed above, and under closed-looped control, the electric motors in both roller skates will rotate at the same target speed indicated by the position of the speed control switch 159, in some embodiments.

Disclosed embodiments achieve advantages. The disclosed roller skates, by using the barrel-shaped rear wheel and using steering truck for the front wheels, among other features, allow for better handling (e.g., carving maneuver) and performance. The ergonomically designed remote control allows for easy gripping without fatigue. The speed of the roller skates may be adjusted easily and continuously by rotating the speed control switch forward or backward. The downhill braking assist function enhances control and safety for the rider. The size of the roller skate can be adjusted easily to accommodate different shoe sizes. In addition, the calibration process may be performed anytime throughout the lifetime of the roller skate to compensate for differences in the measured rotational speed caused by, e.g., environmental factors or component aging, thus prolonging the life of the product and enhancing the performance of the product.

In an embodiment, an electric roller skate system includes a pair of roller skates, wherein each roller skate of the pair of roller skates comprises: a base configured to receive a foot of a rider, wherein the base comprises a front base and a rear base, wherein a distance between the front base and the rear base is adjustable; a front main body attached to the front base; a rear main body attached to the rear base; an ankle strap attached to the rear main body, wherein the front main body, the rear main body, and the ankle strap are configured to fasten the foot of the rider to the base; two front wheels attached to a bottom of the front base; a rear wheel attached to a bottom of the rear base, wherein a cross-section of the rear wheel has a barrel shape; a battery; and an electric motor mechanically coupled to the rear wheel. In an embodiment, the cross-section of the rear wheel has two straight sidewalls, a convex upper surface, and a convex lower surface, wherein the convex upper surface and the convex lower surface extend continuously from a first one of the straight sidewalls to a second one of the straight sidewalls. In an embodiment, the front main body is disposed below the front base, wherein a first portion of the rear main body is disposed below the rear base, and a second portion of the rear main body is disposed above the rear base. In an embodiment, each roller skate further comprises a toe strap attached to the front base. In an embodiment, the front main body and the rear main body are disposed above the base, wherein besides the ankle strap, there is no other strap for each roller skate. In an embodiment, each roller skate further comprises an adjustment button for adjusting the distance between the front base and the rear base. In an embodiment, each roller skate further comprises a speed sensor configured to measure a speed of the roller skate, wherein the electric roller skate system further comprises a remote control for controlling the speed of the roller skate. In an embodiment, the remote control has a speed control switch that is spring-loaded, wherein the roller skate is configured to move forward when the speed control switch is pushed in a first direction, and is configured to move backward when the speed control switch is pushed in a second direction opposite the first direction. In an embodiment, each roller skate further comprises: a tilt sensor configured to measure a tilt angle of the roller skate; and a processor coupled to the speed sensor and the tilt sensor, wherein the processor is configured to: monitor sensor data from the tilt sensor and the speed sensor; detect, based on the sensor data, that the roller skate is going downhill and the speed of the roller skate is above a speed set by the rider; and in response to detecting that the roller skate is going downhill and the speed of the roller skate is above the speed set by the rider, apply electric braking to the roller skate to reduce the speed of the roller skate. In an embodiment, the electric roller skate system is configured to perform a calibration of the speed sensors of the pair of roller skates by: setting the pair of roller skates in a calibration mode, wherein the pair of roller skates comprises a first roller skate and a second roller skate; rotating a first wheel of the first roller skate and a second wheel of the second roller skate at a same speed, wherein a first speed sensor of the first roller skate is coupled to the first wheel, and a second speed sensor of the second roller skate is coupled to the second wheel; recording a plurality of sets of speed measurement, wherein each set of speed measurement comprises a first speed measurement provided by the first speed sensor, and comprises a second speed measurement provided by the second speed sensor, wherein the first speed measurement and the second speed measurement are taken at a same time instant; and performing a curve fitting process using the plurality of sets of speed measurement to generate a fitting curve, wherein the fitting curve indicates a one-to-one mapping between the first speed measurement and the second speed measurement at different speeds. In an embodiment, the electric roller skate system is configured to, in a normal operation mode, adjust a target speed for at least one of the pair of roller skates based on a user-defined target speed and the fitting curve.

In an embodiment, an electric roller skate system includes: a remote control; a first roller skate; and a second roller skate, wherein the first roller skate and the second roller skate are configured to communicate with the remote control through wireless communication, wherein each roller skate of the first and second roller skates comprises: a base configured to receive a foot of a rider, wherein the base comprises a front base and a rear base, wherein a distance between the front base and the rear base is adjustable; an ankle strap configured to fasten the foot of the rider to the base; two front wheels attached to a bottom of the front base; a rear wheel attached to a bottom of the rear base, wherein a cross-section of the rear wheel has a barrel shape; a battery; and an electric motor mechanically coupled with the rear wheel. In an embodiment, the cross-section of the rear wheel has two straight sidewalls on opposing sides, a convex upper surface, and a convex lower surface, wherein the convex upper surface and the convex lower surface extend continuously from a first one of the straight sidewalls to a second one of the straight sidewalls. In an embodiment, each roller skate further comprises a toe strap, wherein the toe strap and the ankle strap are configured to wrap around a toe portion and an ankle portion of the foot of the rider, respectively, to fasten the foot of the rider to the base. In an embodiment, the two front wheels are attached to the bottom of the front base via a steering truck. In an embodiment, the remote control has a speed control switch for controlling a speed of the first and second roller skates, wherein the first and second roller skates are configured to move forward when the speed control switch is pushed in a first direction, and is configured to move backward when the speed control switch is pushed in a second direction opposite the first direction.

In an embodiment, an electric roller skate system includes: a remote control; and a pair of roller skates, wherein the pair of roller skates are configured to communicate with the remote control through wireless communication, wherein each roller skate of the pair of roller skates comprises: a base configured to receive a foot of a rider, wherein the base comprises a front base and a rear base, wherein a distance between the front base and the rear base is adjustable; two front wheels attached to a bottom of the front base via a steering truck; a rear wheel attached to a bottom of the rear base, wherein a cross-section of the rear wheel has a barrel shape; a speed sensor coupled to the rear wheel; a battery; and an electric motor mechanically coupled with the rear wheel and powered by the battery. In an embodiment, the rear wheel is wider than each of the two front wheels, wherein the cross-section of the rear wheel has two straight sidewalls on opposing sides, a convex upper surface, and a convex lower surface, wherein the convex upper surface and the convex lower surface extend continuously from a first one of the straight sidewalls to a second one of the straight sidewalls. In an embodiment, each roller skate of the pair of roller skates comprises a processor, wherein the processor of a first roller skate of the pair of roller skates is capable of exchanging data with the processor of a second roller skate of the pair of roller skates through wireless communication. In an embodiment, the remote control has a speed control switch that is spring-loaded, wherein the pair of roller skates are configured to move forward when the speed control switch is pushed in a first direction, and are configured to move backward when the speed control switch is pushed in a second direction opposite the first direction.

While this invention has been described with reference to illustrative examples, this description is not intended to be construed in a limiting sense. Various modifications and combinations of the illustrative examples, as well as other examples of the invention, will be apparent to persons skilled in the art upon reference to the description. It is therefore intended that the appended claims encompass any such modifications or examples.

What is claimed is:

1. An electric roller skate system comprising:

a pair of roller skates operable in a configuration mode and a normal mode, wherein each roller skate of the pair of roller skates comprises:

a base configured to receive a foot of a rider, wherein the base comprises a front base and a rear base, wherein a distance between the front base and the rear base is adjustable;

a front main body attached to the front base;

a rear main body attached to the rear base;

an ankle strap attached to the rear main body, wherein the front main body, the rear main body, and the ankle strap are configured to fasten the foot of the rider to the base;

two front wheels attached to a bottom of the front base;

a rear wheel attached to a bottom of the rear base, wherein a cross-section of the rear wheel has a barrel shape;

a battery;

an electric motor mechanically coupled to the rear wheel; and a speed sensor a speed sensor configured to measure a speed of the roller skate, wherein the electric roller skate system is configured to perform a calibration of the speed sensors of the pair of roller skates by:

setting the pair of roller skates in a calibration mode;

recording a plurality of sets of speed measurement provided by the speed sensors of the pair of roller skates, wherein each set of speed measurement comprises a first speed measurement provided by the first speed sensor, and comprises a second speed measurement provided by the second speed sensor; and performing a curve fitting process using the plurality of sets of speed measurement to generate a fitting curve for use by the pair of roller skates in a normal mode of operation, wherein the fitting curve indicates a one-to-one mapping between the first speed measurement and the second speed measurement at different speeds.

2. The electric roller skate system of claim 1, wherein the cross-section of the rear wheel has two straight sidewalls, a convex upper surface, and a convex lower surface, wherein the convex upper surface and the convex lower surface extend continuously from a first one of the straight sidewalls to a second one of the straight sidewalls.

3. The electric roller skate system of claim 1, wherein the front main body is disposed below the front base, wherein a first portion of the rear main body is disposed below the rear base, and a second portion of the rear main body is disposed above the rear base.

4. The electric roller skate system of claim 3, wherein each roller skate further comprises a toe strap attached to the front base.

5. The electric roller skate system of claim 1, wherein the front main body and the rear main body are disposed above the base, wherein besides the ankle strap, there is no other strap for each roller skate.

6. The electric roller skate system of claim 1, wherein each roller skate further comprises an adjustment button for adjusting the distance between the front base and the rear base.

7. The electric roller skate system of claim 1, wherein the electric roller skate system further comprises a remote control for controlling the speed of the roller skate.

8. The electric roller skate system of claim 7, wherein the remote control has a speed control switch that is spring-loaded, wherein the roller skate is configured to move forward when the speed control switch is pushed in a first direction, and is configured to move backward when the speed control switch is pushed in a second direction opposite the first direction.

9. The electric roller skate system of claim 7, wherein each roller skate further comprises:

a tilt sensor configured to measure a tilt angle of the roller skate; and a processor coupled to the speed sensor and the tilt sensor, wherein the processor is configured to:

monitor sensor data from the tilt sensor and the speed sensor;

detect, based on the sensor data, that the roller skate is going downhill and the speed of the roller skate is above a speed set by the rider; and in response to detecting that the roller skate is going downhill and the speed of the roller skate is above the speed set by the rider, apply electric braking to the roller skate to reduce the speed of the roller skate.

10. The electric roller skate system of claim 7, wherein the pair of roller skates comprises a first roller skate and a second roller skate;

a first wheel of the first roller skate and a second wheel of the second roller skate are rotated at a same speed, wherein a first speed sensor of the first roller skate is coupled to the first wheel, and a second speed sensor of the second roller skate is coupled to the second wheel; and the first speed measurement and the second speed measurement are taken at a same time instant.

11. The electric roller skate system of claim 10, wherein the electric roller skate system is configured to, in the normal operation mode, adjust a target speed for at least one of the pair of roller skates based on a user-defined target speed and the fitting curve.

12. An electric roller skate system comprising:

a remote control;

a first roller skate comprising a first sensor configured to measure a speed of the first roller skate and a first memory configured to record a first data set of measured speeds of the first roller skate; and a second roller skate comprising a second sensor configured to measure a speed of the second roller skate and a second memory configured to record a second data set of measured speeds of the second roller skate, wherein the first roller skate and the second roller skate are configured to communicate with the remote control through wireless communication, wherein each roller skate of the first and second roller skates comprises:

a base configured to receive a foot of a rider, wherein the base comprises a front base and a rear base, wherein a distance between the front base and the rear base is adjustable;

an ankle strap configured to fasten the foot of the rider to the base;

two front wheels attached to a bottom of the front base;

a rear wheel attached to a bottom of the rear base, wherein a cross-section of the rear wheel has a barrel shape;

a battery;

an electric motor mechanically coupled with the rear wheel; and a processor configured to generate a fitting curve from the first and second data sets, wherein the fitting curve indicates a one-to-one mapping between the measured speeds of the first roller skate and the measured speeds of the second roller skate, wherein the electric motor of the second roller skate is configured to adjust its speed to match a target speed of the electric motor of the first roller skate according to a result of the fitting curve.

13. The electric roller skate system of claim 12, wherein the cross-section of the rear wheel has two straight sidewalls on opposing sides, a convex upper surface, and a convex lower surface, wherein the convex upper surface and the convex lower surface extend continuously from a first one of the straight sidewalls to a second one of the straight sidewalls.

14. The electric roller skate system of claim 12, wherein each roller skate further comprises a toe strap, wherein the toe strap and the ankle strap are configured to wrap around a toe portion and an ankle portion of the foot of the rider, respectively, to fasten the foot of the rider to the base.

15. The electric roller skate system of claim 12, wherein the two front wheels are attached to the bottom of the front base via a steering truck.

16. The electric roller skate system of claim 12, wherein the remote control has a speed control switch for controlling a speed of the first and second roller skates, wherein the first and second roller skates are configured to move forward when the speed control switch is pushed in a first direction, and is configured to move backward when the speed control switch is pushed in a second direction opposite the first direction.

17. An electric roller skate system comprising:

a remote control; and a pair of roller skates, wherein the pair of roller skates are configured to communicate with the remote control through wireless communication, wherein each roller skate of the pair of roller skates comprises:

a base configured to receive a foot of a rider, wherein the base comprises a front base and a rear base, wherein a distance between the front base and the rear base is adjustable;

two front wheels attached to a bottom of the front base via a steering truck;

a rear wheel attached to a bottom of the rear base, wherein a cross-section of the rear wheel has a barrel shape, wherein the rear wheel has two straight sidewalls on opposing sides and a first width as measured from a first one of the straight sidewalls of the rear wheel to a second one of the straight sidewalls of the rear wheel and each of the front wheels has two straight sidewalls on opposing sides and a second width as measured from a first one of the straight sidewalls of the front wheel to a second one of the straight sidewalls of the front wheel, and wherein the first width is greater than or equal to twice the second width;

a speed sensor coupled to the rear wheel;

a battery; and an electric motor mechanically coupled with the rear wheel and powered by the battery.

18. The electric roller skate system of claim 17, wherein the rear wheel comprises two symmetric portions that are joined at the middle and share a common inner sidewall, and wherein the cross-section of the rear wheel has the two straight sidewalls on opposing sides, a convex upper surface, and a convex lower surface, wherein the convex upper surface and the convex lower surface of each of the two symmetric portions extend continuously from one of the straight sidewalls to the common inner sidewall.

19. The electric roller skate system of claim 17, wherein each roller skate of the pair of roller skates comprises a processor, wherein the processor of a first roller skate of the pair of roller skates is capable of exchanging data with the processor of a second roller skate of the pair of roller skates through wireless communication.

20. The electric roller skate system of claim 17, wherein the remote control has a speed control switch that is spring-loaded, wherein the pair of roller skates are configured to move forward when the speed control switch is pushed in a first direction, and are configured to move backward when the speed control switch is pushed in a second direction opposite the first direction.

* * * * *